US011315464B2

(12) United States Patent
Park et al.

(10) Patent No.: US 11,315,464 B2
(45) Date of Patent: Apr. 26, 2022

(54) DISPLAY DEVICE

(71) Applicant: SAMSUNG DISPLAY CO., LTD., Yongin-si (KR)

(72) Inventors: Haeng Won Park, Yongin-si (KR); Chan Jae Park, Yongin-si (KR); Seok Hyun Nam, Yongin-si (KR); Jin Ho Cho, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/087,899

(22) Filed: Nov. 3, 2020

(65) Prior Publication Data

US 2021/0319736 A1 Oct. 14, 2021

(30) Foreign Application Priority Data

Apr. 10, 2020 (KR) ..... 10-2020-0044130

(51) Int. Cl.
*G09G 3/20* (2006.01)

(52) U.S. Cl.
CPC ..... *G09G 3/20* (2013.01); *G09G 2310/027* (2013.01); *G09G 2310/0267* (2013.01); *G09G 2330/028* (2013.01)

(58) Field of Classification Search
CPC ..... G09G 3/20; G09G 2310/0267; G09G 2330/028; G09G 2310/027
See application file for complete search history.

(56) References Cited

U.S. PATENT DOCUMENTS

| | | | | |
|---|---|---|---|---|
| 10,608,020 | B2 * | 3/2020 | Lin | H01L 27/124 |
| 10,650,730 | B2 | 5/2020 | Son et al. | |
| 2017/0250168 | A1 | 8/2017 | Do et al. | |
| 2018/0174519 | A1 * | 6/2018 | Kim | G09G 3/3233 |
| 2019/0156733 | A1 | 5/2019 | Park et al. | |
| 2021/0035492 | A1 | 2/2021 | Lee | |
| 2021/0134877 | A1 | 5/2021 | Kim et al. | |

FOREIGN PATENT DOCUMENTS

| | | |
|---|---|---|
| KR | 10-1845907 | 4/2018 |
| KR | 10-2018-0071062 | 6/2018 |
| KR | 10-2019-0002178 | 1/2019 |
| KR | 10-2019-0057183 | 5/2019 |
| KR | 10-2021-0016211 A | 2/2021 |
| KR | 10-2021-0054117 A | 5/2021 |

* cited by examiner

*Primary Examiner* — Andrew Sasinowski
(74) *Attorney, Agent, or Firm* — Lewis Roca Rothgerber Christie LLP

(57) ABSTRACT

The present invention relates to a display device. Specifically, a display device according to an embodiment of the present invention includes pixels and a data driver, wherein each of the pixels includes a first light-emitting diode aligned in a first direction; a first pixel circuit for driving the first light-emitting diode; a second light-emitting diode aligned in a second direction; and a second pixel circuit for driving the second light-emitting diode, and wherein the data driver supplies a first data signal to the first pixel circuit, and supplies a second data signal to the second pixel circuit during one frame period.

19 Claims, 30 Drawing Sheets

DISPLAY DEVICE

CROSS-REFERENCE TO RELATED APPLICATION

This application claims priority under 35 U.S.C. § 119 to and the benefit of Korean Patent Application No. 10-2020-0044130 filed in the Korean Intellectual Property Office on Apr. 10, 2020, the entire contents of which are incorporated by reference.

FIELD OF THE INVENTION

The present invention relates to display devices, and more particularly relates to a display pixel having light-emission elements of opposite polarities.

DISCUSSION OF RELATED ART

The importance of display devices has increased with developments in multimedia, for example. In response to this, various types of display devices such as an organic light-emitting diode display, a liquid crystal display, and the like have been used. In addition, the display device may include a light-emitting diode, for example, an organic light-emitting diode using an organic material as a fluorescent material, an inorganic light-emitting diode using an inorganic material as a fluorescent material, or the like.

SUMMARY

An inorganic light-emitting diode, such as using an inorganic semiconductor as a fluorescent material, may have durability even in high temperature environments and may have high blue light efficiency compared to an organic light-emitting diode. In a manufacturing process of such an inorganic light-emitting diode, a transcription method using dielectrophoresis (DEP) may be applied. In DEP, a force is exerted on a dielectric when it is subjected to a non-uniform electric field, where the strength of the force depends on the electrical properties of the dielectric.

An embodiment of the present invention provides a display device that minimizes the difference in luminance between frames and substantially prevents a flicker from occurring when the frame is changed by driving all light-emitting diodes included in a pixel.

An embodiment of the present invention provides a display device that minimizes the difference in luminance between pixels disposed on the same horizontal line (or the same pixel row) and improves reliability by driving all light-emitting diodes included in the pixel.

Embodiments of the present invention are not limited to those mentioned above, and other technical options that are not mentioned may be clearly understood to a person of ordinary skill in the art based on the following description.

A display device according to an embodiment of the present invention includes pixels connected to data lines; and a data driver supplying data signals to the data lines, wherein each of the pixels includes a first light-emitting diode aligned in a first direction; a first pixel circuit for driving the first light-emitting diode; a second light-emitting diode aligned in a second direction; and a second pixel circuit for driving the second light-emitting diode, and wherein the data driver supplies a first data signal to the first pixel circuit, and supplies a second data signal to the second pixel circuit during one frame period.

In an embodiment, the data driver may supply the first data signal during a first period in a first frame period, and supply the second data signal during a second period after the first period in the first frame period, and may supply the first data signal during the first period in a second frame period, and supply the second data signal during the second period in the second frame period.

In an embodiment, the first pixel circuit may include a first transistor including a first electrode connected to the first power line, a second electrode connected to a first node, and a gate electrode connected to a second node, wherein the first node is connected to a first electrode of the first light-emitting diode and a second electrode of the second light-emitting diode; a second transistor connected between the data line and the second node and including a gate electrode connected to the first scan line; and a third transistor connected between the first node and the sensing line and including a gate electrode connected to the second scan line.

In an embodiment, the pixels may be connected to third scan lines and fourth scan lines, and the second pixel circuit may include a fourth transistor including a first electrode connected to the second power line, a second electrode connected to a third node, and a gate electrode connected to a fourth node, wherein the third node is connected to a second electrode of the first light-emitting diode and a first electrode of the second light-emitting diode; a fifth transistor connected between the data line and the fourth node and including a gate electrode connected to the third scan line; and a sixth transistor connected between the third node and the sensing line and including a gate electrode connected to the fourth scan line.

In an embodiment, in a first frame period, a first scan signal at a turn-on level may be supplied to the first scan line during a first period, and a second scan signal at the turn-on level may be supplied to the second scan line during the first period, and, during the first period, the first data signal may be supplied to the second node, and an initialization voltage may be supplied to the sensing line.

In an embodiment, in the first frame period, a third scan signal at the turn-on level may be supplied to the third scan line during a second period after the first period, and a fourth scan signal at the turn-on level may be supplied to the fourth scan line during the second period, and, during the second period, the second data signal may be supplied to the fourth node, and the initialization voltage may be supplied to the sensing line.

In an embodiment, the first data signal may be a signal corresponding to a grayscale value, and the second data signal may be the same signal as the first data signal, or be a signal at a level that turns on the fourth transistor without corresponding to the grayscale value.

In an embodiment, in a second frame period different from a first frame period, a third scan signal at the turn-on level may be supplied to the third scan line during a first period, and a fourth scan signal at the turn-on level may be supplied to the fourth scan line during the first period, and, during the first period, the first data signal may be supplied to the fourth node, and an initialization voltage may be supplied to the sensing line.

In an embodiment, in the second frame period, a first scan signal at the turn-on level may be supplied to the first scan line during a second period after the first period, and a second scan signal at the turn-on level may be supplied to the second scan line during the second period, and, during the second period, the second data signal may be supplied to the second node, and the initialization voltage may be supplied to the sensing line.

In an embodiment, the first data signal may be a signal corresponding to a grayscale value, and the second data signal may be the same signal as the first data signal, or be a signal at a level that turns on the first transistor without corresponding to the grayscale value.

In an embodiment, the second scan line and the fourth scan line may be the same, and the second scan signal and the fourth scan signal may be the same.

In an embodiment, the second scan signal or the fourth scan signal may be supplied during the same period.

In an embodiment, the display device may further include a power supply that supplies a first power voltage at a first level and a second power voltage at a second level lower than the first level in a first frame period, and supplies the first power voltage at the second level and the second power voltage at the first level in a second frame period.

In an embodiment, the first pixel circuit may include a first transistor including a first electrode connected to the first power line, a second electrode connected to a first node, and a gate electrode connected to a second node, wherein the first node is connected to a first electrode of the first light-emitting diode and a second electrode of the second light-emitting diode; a second transistor connected between the data line and the second node and including a gate electrode connected to the first scan line; a third transistor connected between the first node and the sensing line and including a gate electrode connected to the second scan line; and a fourth transistor including a first electrode connected to the second power line, a second electrode connected to a third node, and a gate electrode connected to the second node, wherein the third node is connected to a second electrode of the first light-emitting diode and a first electrode of the second light-emitting diode.

In an embodiment, the pixels may be connected to third scan lines and fourth scan lines, and the second pixel circuit may include a fifth transistor including a first electrode connected to the first power line, a second electrode connected to the third node, and a gate electrode connected to a fourth node; a sixth transistor connected between the data line and the fourth node and including a gate electrode connected to the third scan line; a seventh transistor connected between the third node and the sensing line and including a gate electrode connected to the fourth scan line; and an eighth transistor including a first electrode connected to the second power line, a second electrode connected to the first node, and a gate electrode connected to the fourth node.

In an embodiment, in the one frame period, a first scan signal at a turn-on level may be supplied to the first scan line during a first period, and a second scan signal at the turn-on level may be supplied to the second scan line during the first period, and during the first period, the first data signal may be supplied to the second node, and an initialization voltage may be supplied to the sensing line.

In an embodiment, in the one frame period, a third scan signal at the turn-on level may be supplied to the third scan line during a second period after the first period, and a fourth scan signal at the turn-on level may be supplied to the fourth scan line during the second period, and, during the second period, the second data signal is supplied to the fourth node, and the initialization voltage is supplied to the sensing line.

In an embodiment, the first data signal and the second data signal may be signals corresponding to grayscale values.

In an embodiment, the second scan line and the fourth scan line may be the same, and the second scan signal and the fourth scan signal may be the same.

In an embodiment, the second scan signal or the fourth scan signal may be supplied during the same period.

In an embodiment, the display device may further include a power supply that supplies a first power voltage to the first power line, and supplies a second power voltage lower than the first power voltage to the second power line.

In an embodiment, the pixels may be connected to third scan lines and fourth scan lines, a first pixel circuit of a first pixel of the pixels may be connected to the first scan line and the second scan line, a second pixel circuit of the first pixel may be connected to the third scan line and the fourth scan line, a first pixel circuit of a second pixel disposed on the same pixel row as the first pixel may be connected to the second scan line and the third scan line, and a second pixel circuit of the second pixel may be connected to the first scan line and the fourth scan line.

An embodiment display panel includes a data driver connected to a first plurality of data lines; and a first plurality of pixels each connected to a corresponding one of the first plurality of data lines, respectively, and to a pair of switchable polarity power lines, wherein each of the first plurality of pixels includes a first light-emitting diode arranged with a first polarity, and a second light-emitting diode disposed in parallel with the first light-emitting diode and arranged with a second polarity opposite to the first polarity.

In an embodiment display panel, each of the plurality of pixels may further include a first circuit for driving the first light-emitting diode; and a second circuit for driving the second light-emitting diode, wherein the data driver supplies a first data signal through a first of the first plurality of data lines to the first circuit, and supplies a second data signal through the first of the first plurality of data lines to the second circuit during a same frame period.

An embodiment pixel includes at least one first transistor having a first control terminal connected to a scan line, a first input terminal connected to a data line, and a first output terminal; at least one second transistor having a second control terminal connected to the first output terminal, a second input terminal connected to a first power line, and a second output terminal; a first capacitor connected between the first output terminal and the second output terminal; a first light-emitting diode having a first anode connected to the second output terminal, and a first cathode; and a second light-emitting diode having a second anode connected to the first cathode, and a second cathode connected to the first anode.

In an embodiment pixel, the pixel may further include at least one third transistor having a third control terminal connected to the scan line, a third input terminal connected to the data line, and a third output terminal; and at least one fourth transistor having a fourth control terminal connected to the third output terminal, a fourth input terminal connected to a second power line, and a fourth output terminal; a second capacitor connected between the third output terminal and the fourth output terminal.

An embodiment of the present invention may minimize the difference in luminance between frames, and can prevent a flicker from occurring when the frame is changed by driving all light-emitting diodes included in a pixel.

An embodiment of the present invention may minimize the difference in luminance between pixels disposed on the same horizontal line (or the same pixel row), and can improve reliability of the display device by driving all light-emitting diodes included in the pixel.

Effects of an embodiment of the present invention are not limited by the above. Particularities of other embodiments may be included in the detailed description and drawings that follow.

DETAILED DESCRIPTION

Figure 1:
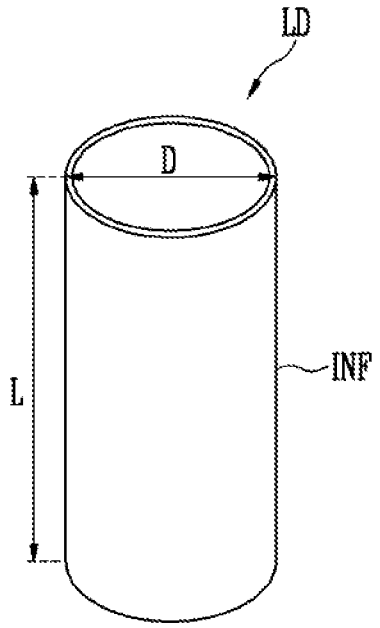
FIG. 1 is a perspective diagram showing a light-emitting diode according to an embodiment of the present invention.

Embodiments of the present invention, including implementation methods thereof, will be described by way of example through the following embodiments described with reference to the accompanying drawings. The present invention may, however, be embodied in different forms and should not be construed as limited to the embodiments set forth herein. Rather, these embodiments are provided so that this disclosure will be thorough and complete, and will fully convey the scope of the present invention to those skilled in the art. Further, the present invention is only defined by scopes of claims.

Hereinafter, referring to the accompanying drawings, an embodiment of the present disclosure will be described in further detail. The same or similar reference numerals may be used for the same or similar constituent elements in the drawings, and duplicate description thereof may be omitted.

Figure 2:
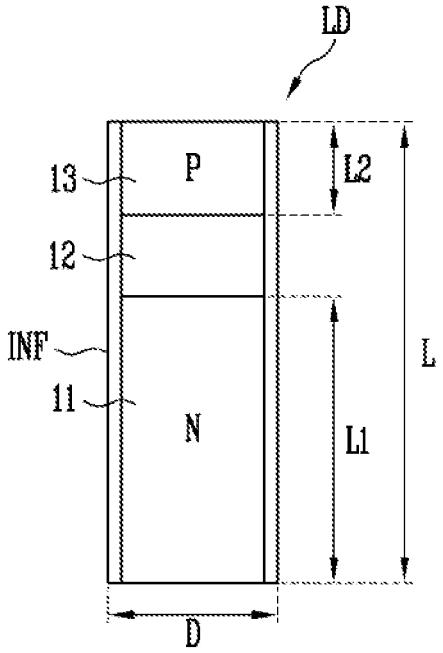
FIG. 2 is a cross-sectional diagram of a light-emitting diode shown in FIG. 1.

FIG. 1 is a perspective view showing a light-emitting diode according to an embodiment of the present invention, and FIG. 2 is a cross-sectional view of a light-emitting diode shown in FIG. 1.

Referring to FIGS. 1 and 2, a light-emitting diode LD may include a first semiconductor layer 11, a second semiconductor layer 13, and an active layer 12 interposed between the first semiconductor layer 11 and the second semiconductor layer 13. For example, the light-emitting diode LD may have a structure in which the first semiconductor layer 11, the active layer 12, and the second semiconductor layer 13 are sequentially stacked in one direction.

According to an embodiment, the light-emitting diode LD may be provided in a rod shape extending in one direction. The light-emitting diode LD may have one end (first end) and the other end (second end) aligned in substantially one direction.

According to an embodiment, one of the first semiconductor layer 11 or the second semiconductor layer 13 may be disposed at one end of the light-emitting diode LD, and the other of the first semiconductor layer 11 or the second semiconductor layer 13 may be disposed at the other end of the light-emitting diode LD.

According to an embodiment, the light-emitting diode LD may be manufactured as a rod-shaped light-emitting diode. Here, the rod shape may include a rod-like shape or a bar-like shape that is longer in a length direction than in a width direction (i.e., an aspect ratio is greater than 1), such as a cylinder or a polygonal pillar, and a shape of a cross-section thereof is not particularly limited. For example, a length L of the light-emitting diode LD may be greater than a diameter D (or a width of a transverse cross-section) thereof. FIGS. 1 and 2 show the rod-shaped light-emitting diode LD of a cylinder shape, but neither a type nor a shape of the light-emitting diode LD according to the present invention is limited thereto.

According to an embodiment, the light-emitting diode LD may have a size as small as a nanometer scale to a micrometer scale, for example, such as with a diameter Dora length L in a range of 100 nm to 10 μm. However, the size of the light-emitting diode LD is not limited thereto. For example, the size of the light-emitting diode LD may be variously changed according to design conditions of a display device using the light-emitting diode LD.

The first semiconductor layer 11 may include at least one N-type semiconductor material. For example, the first semiconductor layer 11 may include a semiconductor material of InAlGaN, GaN, AlGaN, InGaN, AlN, and/or InN, and may include an N-type semiconductor material doped with a first conductive dopant such as Si, Ge, Sn, or the like. However, the material constituting the first semiconductor layer 11 is not limited thereto, and various other materials may constitute the first semiconductor layer 11.

The active layer 12 may be disposed on the first semiconductor layer 11 and may be formed in a single or multiple quantum-well structure. In an embodiment, a clad layer with which a conductive dopant is doped may be formed on and/or under the active layer 12. For example, the clad layer may be formed of an AlGaN layer or an InAlGaN layer. According to an embodiment, materials such as AlGaN, AlInGaN, and the like may be used to form the active layer 12, and in addition, various materials may constitute the active layer 12. In other words, the active layer 12 may be disposed between the first semiconductor layer 11 and the second semiconductor layer 13 described below.

When a voltage equal to or higher than a threshold voltage is applied across both ends of the light-emitting diode LD, the light-emitting diode LD may emit light while electron-hole pairs are combined in the active layer 12. By controlling light emission of the light-emitting diode LD using this principle, the light-emitting diode LD may be used as a light source for various light-emitting devices including a pixel of a display device.

The second semiconductor layer 13 may be disposed on the active layer 12, and may include a semiconductor material of a type different from the first semiconductor layer 11. For example, the second semiconductor layer 13 may include at least one P-type semiconductor material. For example, the second semiconductor layer 13 may include at least one semiconductor material of InAlGaN, GaN, AlGaN, InGaN, AlN, and InN, and may include a P-type semiconductor material doped with a second conductive dopant such as Mg, or the like. However, the material constituting the second semiconductor layer 13 is not limited thereto, and various other materials may constitute the second semiconductor layer 13.

According to an embodiment, a first length L1 of the first semiconductor layer 11 may be longer than a second length L2 of the second semiconductor layer 13.

According to an embodiment, the light-emitting diode LD may further include an insulation film INF provided on a surface thereof. The insulation film INF may be formed on the surface of the light-emitting diode LD to surround at least an outer circumferential surface of the active layer 12, and may further cover a portion of the first semiconductor layer 11 and the second semiconductor layer 13.

However, according to an embodiment, the insulation film INF may expose both ends of the light-emitting diode LD having different polarities. For example, the insulation film INF may expose without cover one end of each of the first semiconductor layer 11 and the second semiconductor layer 13, disposed at both ends of the light-emitting diode LD in the length direction, such as, for example, two planes of the cylinder (e.g., the top and bottom surfaces). In an embodiment, the insulation film INF may expose both ends of a light-emitting diode LD having a different polarity and sides of semiconductor layers 11 and 13 adjacent to both ends.

According to an embodiment, the insulation film INF may include at least one insulation material of silicon oxide ($SiO_2$), silicon nitride ($Si_3N_4$), aluminum oxide ($Al_2O_3$), or titanium dioxide $TiO_2$, but is not limited thereto. That is, the constituent material of the insulation film INF is not particularly limited, and the insulation film INF may be made of various insulation materials known in the art.

In an embodiment, the light-emitting diode LD may further include an additional constituent element in addition to the first semiconductor layer 11, the active layer 12, and the second semiconductor layer 13 and/or the insulation film INF. For example, the light-emitting diode LD may further include at least one fluorescent layer, an active layer, a semiconductor material and/or an electrode layer disposed on one side of the first semiconductor layer 11, the active layer 12 and/or the second semiconductor layer 13.

Figure 3:
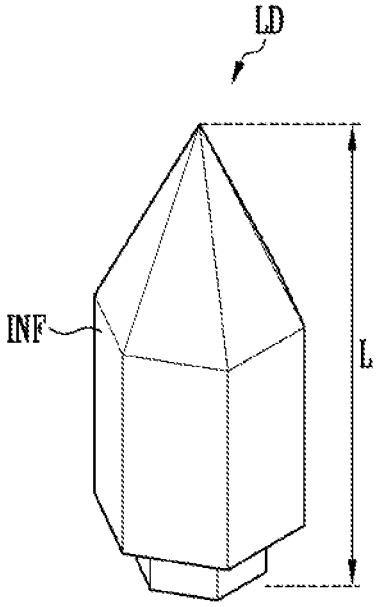
FIG. 3 is a perspective diagram showing a light-emitting diode according to an embodiment of the present invention.
Figure 4:
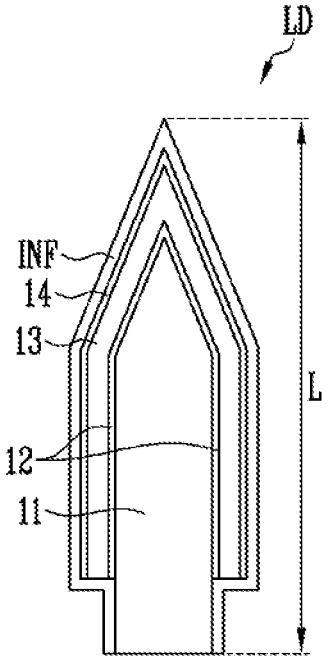
FIG. 4 is a cross-sectional diagram of a light-emitting diode shown in FIG. 3.

FIG. 3 is a perspective view showing a light-emitting diode according to an embodiment of the present invention, and FIG. 4 is a cross-sectional view of a light-emitting diode shown in FIG. 3.

Referring to FIGS. 3 and 4, the light-emitting diode LD according to an embodiment includes a first semiconductor layer 11, a second semiconductor layer 13, and an active layer 12 interposed between the first semiconductor layer 11 and the second semiconductor layer 13. According to an embodiment, the first semiconductor layer 11 may be disposed in a central region of the light-emitting diode LD, and the active layer 12 may be disposed on a surface of the first semiconductor layer 11 to cover at least a portion of the first semiconductor layer 11. In addition, the second semiconductor layer 13 may be disposed on a surface of the active layer 12 to cover at least a portion of the active layer 12.

In addition, the light-emitting diode LD may further include an electrode layer 14 and/or an insulation film INF covering at least a portion of the second semiconductor layer 13. For example, the light-emitting diode LD may further include an electrode layer 14 disposed on a surface of the second semiconductor layer 13 to cover at least a portion of the second semiconductor layer 13, and an insulation film INF disposed on a surface of the electrode layer 14 to cover at least a portion of the electrode layer 14. That is, the light-emitting diode LD according to the embodiment described above may be implemented as a core-shell structure including the first semiconductor layer 11, the active layer 12, the second semiconductor layer 13, the electrode layer 14, and the insulation film INF sequentially disposed from the center to the outside. The electrode layer 14 and/or the insulation film INF may be omitted according to an embodiment.

In an embodiment, the light-emitting diode LD may be provided in a polygonal pyramid shape extending in one direction. For example, at least one region of the light-emitting diode LD may have a hexagonal pyramid shape. However, the shape of the light-emitting diode LD is not limited thereto, and may be variously changed.

When an extension direction of the light-emitting diode LD is called a direction of a length L, the light-emitting diode LD may have one end (e.g., a first end) and the other end (e.g., a second end) along the direction of the length L. According to an embodiment, one of the first semiconductor layer 11 or the second semiconductor layer 13 may be disposed at one end of the light-emitting diode LD, and the other of the first semiconductor layer 11 or the second semiconductor layer 13 may be disposed at the other end of the light-emitting diode LD.

In an embodiment of the present invention, the light-emitting diode LD may be an ultra-small light-emitting diode having a core-shell structure made up of a polygonal pillar shape, for example, such as a hexagonal pyramid shape with both ends protruded.

In an embodiment, both ends of the first semiconductor layer 11 may have protruded shapes along the direction of the length L of the light-emitting diode LD. The protruded shapes of both ends of the first semiconductor layer 11 may be different from each other. For example, one end disposed on an upper side of both ends of the first semiconductor layer 11 may have a pyramid shape contacting one vertex as a width thereof narrows upward. In addition, the other end disposed on a lower side of both ends of the first semiconductor layer 11 may have a polygonal pillar shape with a constant width. However, embodiments are not limited thereto.

In an embodiment, the light-emitting diode LD may have a cross-section such as a polygonal shape or a step shape whose width gradually narrows as the first semiconductor layer 11 goes downward.

The shape of both ends of the first semiconductor layer 11 may be variously changed based on any embodiment, and is not limited to the embodiment described above.

According to an embodiment, the first semiconductor layer 11 may be disposed in a core, such as a center or central region of the light-emitting diode LD. In addition, the light-emitting diode LD may be provided in a shape corresponding to the shape of the first semiconductor layer 11. For example, when the first semiconductor layer 11 has a hexagonal pyramid shape, the light-emitting diode LD may have a hexagonal pyramid shape.

Figure 5:
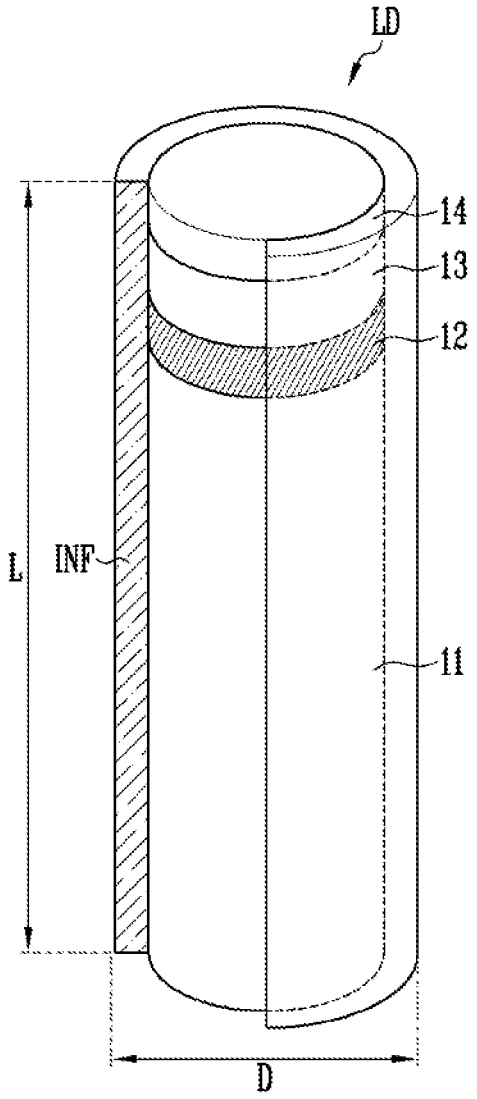
FIG. 5 is a perspective diagram showing a light-emitting diode according to an embodiment of the present invention.
Figure 6:
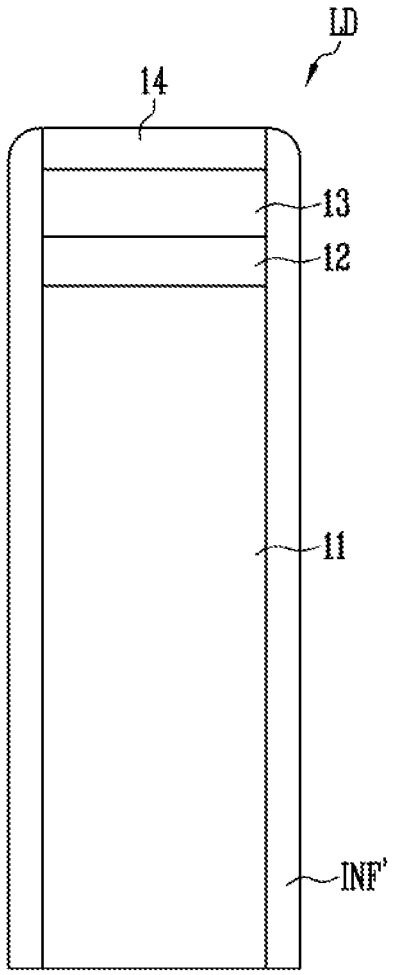
FIG. 6 is a cross-sectional diagram of a light-emitting diode shown in FIG. 5.

FIG. 5 is a perspective view showing a light-emitting diode according to an embodiment of the present invention, and FIG. 6 is a cross-sectional view of a light-emitting diode similar to that shown in FIG. 5. In FIG. 5, a part of the insulation film INF is omitted for better understanding and ease of description. Referring to FIG. 5, the light-emitting diode LD according to an embodiment may include a first semiconductor layer 11, an active layer 12, a second semiconductor layer 13, an electrode layer 14, and the like.

For example, the light-emitting diode LD may have a structure in which the first semiconductor layer 11, the active layer 12, the second semiconductor layer 13, and the electrode layer 14 are sequentially stacked in one direction.

As described above with reference to FIG. 1, the first semiconductor layer 11 may include at least one N-type semiconductor material, for example, one of InAlGaN, GaN, AlGaN, InGaN, AlN, or InN, and may include an N-type semiconductor material doped with a first conductive dopant such as Si, Ge, Sn, and the like.

The active layer 12 may be disposed on the first semiconductor layer 11 and may be formed in a single or multiple quantum-well structure. The active layer 12 may include nitrogen (N). When the active layer 120 includes nitrogen (N), the light-emitting diode LD shown in FIG. 5 may emit blue or green light.

As described above with reference to FIG. 1, the second semiconductor layer 13 may be disposed on the active layer 12, and may include a semiconductor material of a type different from the first semiconductor layer 11, for example, at least one P-type semiconductor material. For example, the second semiconductor layer 13 may include at least one semiconductor material of InAlGaN, GaN, AlGaN, InGaN, AlN, or InN, and may include a P-type semiconductor material doped with a second conductive dopant such as Mg, and the like.

In an embodiment, the electrode layer 14 may be an ohmic contact electrode electrically connected to the second semiconductor layer 13. However, the present invention is not limited thereto, and the electrode layer 14 may be a Schottky contact electrode.

The electrode layer 14 may include metal or metal oxide, and for example, may be made of Cr, Ti, Al, Au, Ni, ITO, IZO, ITZO and oxides or alloys thereof alone or in combination.

The electrode layer 14 may be substantially transparent or translucent. Accordingly, light generated in the active layer 12 of the light-emitting diode LD may pass through the electrode layer 14 and be emitted to the outside of the light-emitting diode LD.

The light-emitting diode LD may further include an electrode layer made of the same material as the electrode layer 14 disposed on the first semiconductor layer 11, and the two electrode layers may define each end of the light-emitting diode LD.

Referring to FIG. 5, the light-emitting diode LD of FIG. 5 may be different from the embodiment of FIG. 1 in that the electrode layer 14 is further disposed. An arrangement and structure of the insulation film INF is substantially the same as the embodiment of FIG. 1 except for the above difference. In FIG. 6, some members are the same or similar to those shown in FIG. 5, but may have optional differences and/or new reference numerals for better understanding and ease of description. Duplicate description may be omitted.

Referring to FIG. 6, in an embodiment, the insulation film INF' may have a curved shape in an edge region adjacent to the electrode layer 14. According to an embodiment, when the light-emitting diode LD is manufactured, the curved surface may be formed by etching.

In the light-emitting diode of an embodiment having a structure further including an electrode layer disposed on the first semiconductor layer 11 described above, the insulation film INF' may have a curved shape in a region adjacent to the electrode layer.

Figure 7:
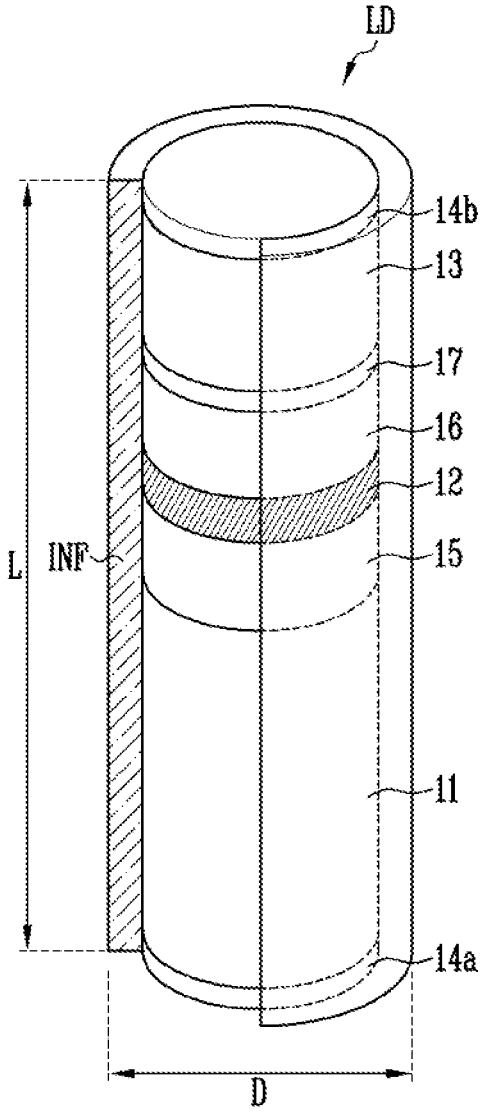
FIG. 7 is a perspective diagram showing a light-emitting diode according to an embodiment of the present invention.

FIG. 7 is a perspective view showing a light-emitting diode according to an embodiment of the present invention.

In FIG. 5, a part of the insulation film INF is omitted for better understanding and ease of description.

Referring to FIG. 7, the light-emitting diode LD according to an embodiment may further include a third semiconductor layer 15 disposed between the first semiconductor layer 11 and the active layer 12, a fourth semiconductor layer 16 and fifth semiconductor layer 17 disposed between the active layer 12 and the second semiconductor layer 13. The light-emitting diode LD of FIG. 7 may be different from the embodiment of FIG. 5 in that a plurality of semiconductor layers 15, 16, and 17 and a plurality of electrode layers 14*a* and 14*b* are further disposed, and the active layer 12 includes another element. An arrangement and structure of the insulation film INF is substantially the same as the embodiment of FIG. 5 except for the above differences. In FIG. 7, some members are the same or similar to those shown in FIG. 5, but may have new reference numerals for better understanding and ease of description. Hereinafter, duplicate descriptions will be omitted and the description will be mainly focused on the differences.

As described above, in the light-emitting diode LD of FIG. 5, the active layer 12 may include nitrogen (N) and emit blue or green light. On the other hand, in the light-emitting diode LD of FIG. 7, each of the active layer 12 and/or other semiconductor layers may be a semiconductor including at least another element, such as phosphorus (P). That is, the light-emitting diode LD according to an embodiment may emit red light having a central wavelength band of 620 nm to 750 nm. However, it should be understood that the central wavelength band of red light is not limited to the above-described range and includes all wavelength ranges capable of recognition as red in the art.

In an embodiment, the light-emitting diode LD may include a clad layer disposed adjacent to the active layer 12. As shown in the drawing, the third semiconductor layer 15 and the fourth semiconductor layer 16 disposed between the first semiconductor layer 11 and the second semiconductor layer 13 on and under the active layer 12 may be clad layers.

The third semiconductor layer 15 may be disposed between the first semiconductor layer 11 and the active layer 12. The third semiconductor layer 15 may be an N-type semiconductor such as the first semiconductor layer 11. For example, the third semiconductor layer 15 may include a semiconductor material having Chemical Formula of InxAlyGa1-x-yP (here 0≤x≤1, 0≤y≤1, 0≤x+y≤1). In an embodiment, the first semiconductor layer 11 may be n-AlGaInP, and third semiconductor layer 15 may be n-AlInP. However, the embodiment is not limited thereto.

The fourth semiconductor layer 16 may be disposed between the active layer 12 and the second semiconductor layer 13. The fourth semiconductor layer 16 may be a P-type semiconductor such as the second semiconductor layer 13. For example, the fourth semiconductor layer 16 may include a semiconductor material having Chemical Formula of InxAlyGa1-x-yP (here 0≤x≤1, 0≤y≤1, 0≤x+y≤1). In an embodiment, the second semiconductor layer 13 may be p-GaP, and the fourth semiconductor layer 16 may be p-AlInP.

The fifth semiconductor layer 17 may be disposed between the fourth semiconductor layer 16 and the second semiconductor layer 13. The fifth semiconductor layer 17 may be a semiconductor doped with a P-type, such as the second semiconductor layer 13 and the fourth semiconductor layer 16. In an embodiment, the fifth semiconductor layer 17 may function to reduce a difference in lattice constant between the fourth semiconductor layer 16 and the second semiconductor layer 13. That is, the fifth semiconductor layer 17 may be a tensile strain barrier reducing (TSBR) layer. For example, the fifth semiconductor layer 17 may include p-GaInP, p-AlInP, p-AlGaInP, but is not limited thereto.

The first electrode layer 14*a* and the second electrode layer 14*b* may be disposed on the first semiconductor layer 11 and the second semiconductor layer 13, respectively. The first electrode layer 14*a* may be disposed on a lower surface of the first semiconductor layer 11, and the second electrode layer 14*b* may be disposed on an upper surface of the second semiconductor layer 13. However, the present invention is not limited thereto, and at least one of the first electrode layer 14*a* and the second electrode layer 14*b* may be omitted according to an embodiment.

Each of the first electrode layer 14*a* and the second electrode layer 14*b* may be include at least one of the materials shown in the electrode layer 14 of FIG. 5.

When the light-emitting diodes LD shown in FIGS. 1 to 7 are applied to the display device according to an embodiment of the present invention, the light-emitting diodes LD shown in FIGS. 1 to 7 may be included in the pixel through an alignment process in which a ink including one or more of the light-emitting diodes LD shown in FIGS. 1 to 7 is applied to lines for alignment of light-emitting diode polarities, such as by application of a conductive ink, but not limited thereto.

In this case, the light-emitting diode LD included in the pixel may be aligned in a forward direction (or first direction) or a reverse direction (or second direction). In general, since a plurality of light-emitting diodes LD are included in the pixel, the pixel may include light-emitting diodes LD aligned in the forward direction (or first direction) and light-emitting diodes LD aligned in the reverse direction (or second direction).

Next, a display device according to an embodiment will be described.

Figure 8:
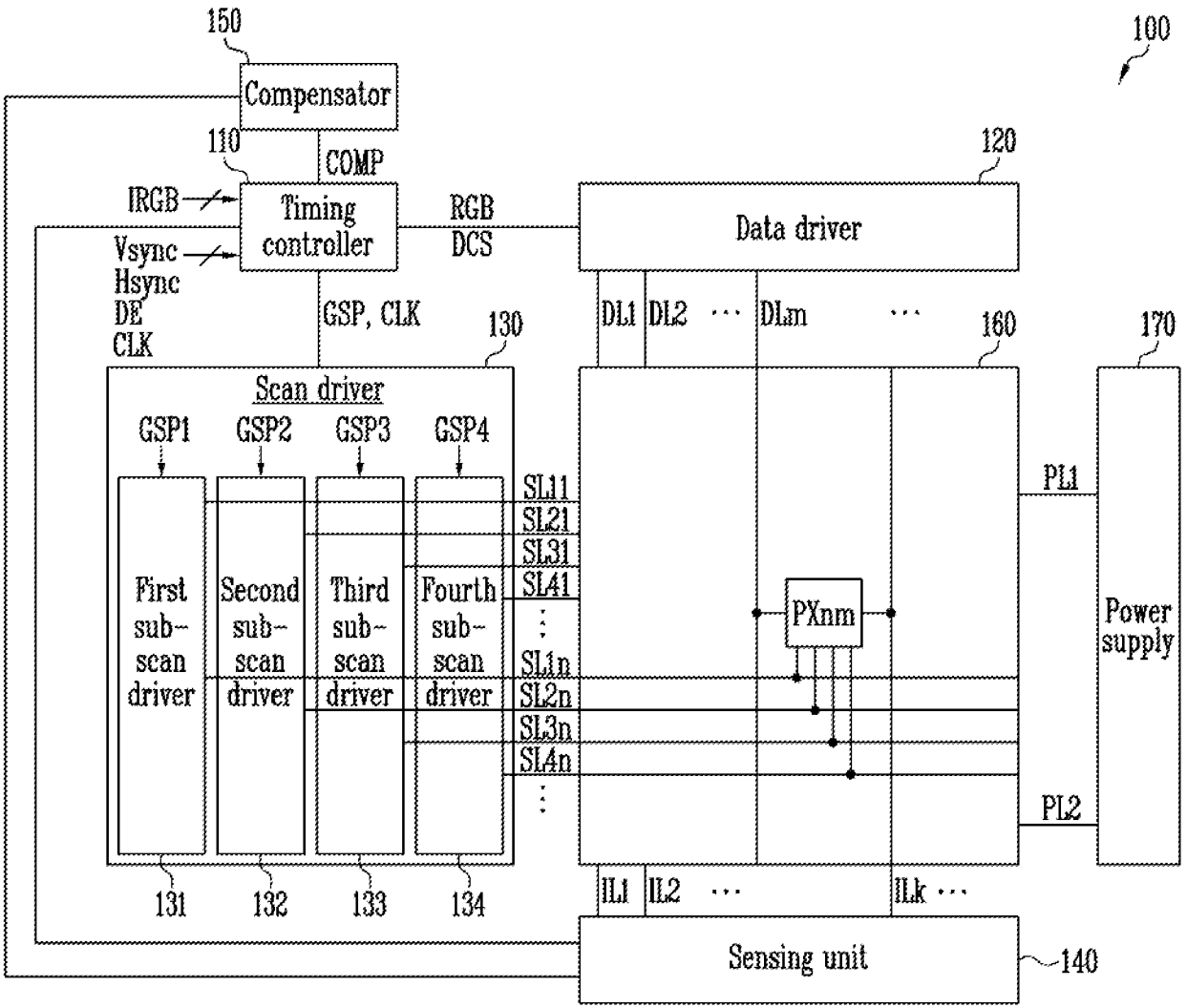
FIG. 8 is a block diagram showing a display device according to an embodiment of the present invention.

FIG. 8 is a block diagram showing a display device according to an embodiment of the present invention.

Referring to FIG. 8, the display device 100 according to an embodiment of the present invention may include a timing controller 110, a data driver 120, a scan driver 130, a sensing unit 140, a compensator 150, a display unit 160, and a power supply 170.

The timing controller 110 may receive input image data IRGB and timing signals Vsync, Hsync, DE, and CLK from a host system such as an application processor (AP) through a predetermined interface. Here, the timing signals Vsync, Hsync, DE, and CLK may include, for example, a vertical synchronization signal Vsync, a horizontal synchronization signal Hsync, a data enable signal DE, and a clock signal CLK.

The vertical synchronization signal Vsync may include a plurality of pulses, and may indicate that the previous frame period ends and the current frame period starts with respect to a time point at which each pulse is generated. The interval between adjacent pulses of the vertical synchronization signal Vsync may correspond to one frame period.

The horizontal synchronization signal Hsync may include a plurality of pulses, and may indicate that the previous horizontal period ends and a new horizontal period starts with respect to a time point at which each pulse is generated. The interval between adjacent pulses of the horizontal synchronization signal Hsync may correspond to one horizontal period.

The data enable signal DE may have an enable level for specific horizontal periods. When the data enable signal DE is at the enable level, it may indicate that input image data IRGB is supplied in corresponding horizontal periods.

The input image data IRGB may be supplied in units of a pixel row in each corresponding horizontal period.

In an embodiment, the timing controller 110 may rearrange the input image data IRGB and supply it to the data driver 120. Specifically, the timing controller 110 may generate image data RGB corresponding to grayscale values based on the input image data IRGB to correspond to a specification of the display device 100, and may supply the image data RGB to the data driver 120.

In an embodiment, the timing controller 110 may receive a compensation value (e.g., a current compensation value COMP as further described below) output by the compensator 150, and may supply image data RGB applying the compensation value to the data driver 120.

The timing controller 110 may generate control signals to be supplied to the data driver 120, the scan driver 130, and the sensing unit 140 based on timing signals Vsync, Hsync, DE, and CLK to correspond to the specification of the display device 100.

In an embodiment, the timing controller 110 may generate a data driving control signal DCS based on the timing signals Vsync, Hsync, DE, and CLK, and supply the data driving control signal DCS to the data driver 120.

In an embodiment, the data driver 120 may convert the rearranged image data RGB into a first data signal (or data voltage) of an analog format. Specifically, the data driver 120 may generate first data signals (or data voltages) to be supplied to data lines DL1, DL2, and DLm by using the image data RGB and the data driving control signal DCS received from the timing controller 110.

For example, the data driver 120 may sample grayscale values by using the clock signal CLK, and may supply the first data signals (or data voltages) to the data lines DL1, DL2, and DLm in unit of pixel row (e.g., the pixels connected to the same scan line).

In an embodiment, the first data signal may be a signal corresponding to a grayscale value.

Figure 9:
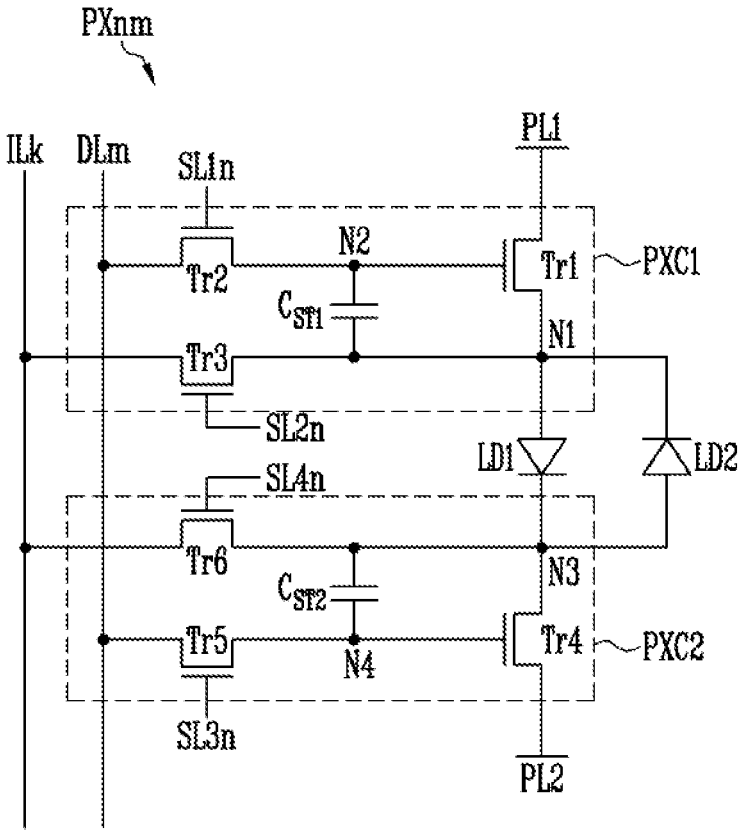
FIG. 9 is a circuit diagram of a pixel according to an embodiment of the present invention.

In an embodiment, the data driver 120 may supply second data signals at a turn-on level, which may turn on driving transistors (e.g., the first transistor Tr1 and fourth transistor Tr4 shown in FIG. 9) included in the pixel PXnm the data lines DL1, DL2, and DLm in unit of pixel row.

In an embodiment, the second data signal may be the same as the first data signal. That is, the second data signal may be a signal corresponding to a grayscale value.

In an embodiment, the second data signal may be different from the first data signal. That is, the second data signal at the turn-on level may not correspond to the grayscale value.

The data driver 120 may supply the first data signals and/or the second data signals to data lines DL1, DL2, and DLm during one frame period. In an embodiment, the first data signal supplied to the data lines DL1, DL2, and DLm may be supplied during a period in which the first scan signal is supplied to the first scan lines SL11 and SL1*n* and a period in which the third scan signal is supplied to the third scan lines SL31 and SL3*n*. In an embodiment, the first data signal supplied to the data lines DL1, DL2, and DLm may be supplied during a period in which the first scan signal is supplied to the first scan lines SL11 and SL1*n*. In addition, in an embodiment, the second data signal supplied to the data lines DL1, DL2, and DLm may be supplied during a period in which the third scan signal is supplied to the third scan lines SL31 and SL3*n*.

In an embodiment, the timing controller 110 may supply gate start pulses GSP and clock signals CLK to the scan driver 130 based on the timing signals Vsync, Hsync, DE, and CLK. Here, the gate start pulse GSP may be used to control a first timing of the scan signal supplied from the scan driver 130, and the clock signal CLK may be used to shift the gate start pulse GSP.

The scan driver 130 may receive the scan signals CLK, the gate start pulses GSP, and the like from the timing controller 110 to generate scan signals supplied to scan lines SL11, SL21, SL31, SL41, SL1*n*, SL2*n*, SL3*n*, and SL4*n*. Here, n may be a natural number.

The scan driver 130 may include a plurality of sub-scan drivers 131, 132, 133, and 134. For example, the scan driver 130 may be divided into the configuration and operation of a first sub-scan driver 131, a second sub-scan driver 132, a third sub-scan driver 133, and a fourth sub-scan driver 134. In this case, the gate start pulses GSP may include a first gate start pulse GSP1, a second gate start pulse GSP2, a third gate start pulse GSP3, and a fourth gate start pulse GSP4. The pulse widths of the gate start pulses GSP may be different with each other, and a width of the scan signal corresponding thereto may also be different. A plurality of sub-scan drivers 131, 132, 133, and 134 may commonly receive the clock signals CLK.

The distinction between the scan driver 130 and the gate start pulse GSP is for better understanding and ease of description.

In an embodiment, the first sub-scan driver 131 may supply first scan signals sequentially to the first scan lines SL11 and SL1*n* in response to the first gate start pulse GSP1, the second sub-scan driver 132 may supply second scan signals sequentially to the second scan lines SL21 and SL2*n* in response to the second gate start pulse GSP2, the third sub-scan driver 133 may supply third scan signals sequentially to the third scan lines SL31 and SL3*n* in response to the third gate start pulse GSP3, and the fourth sub-scan driver 134 may supply fourth scan signals sequentially to the fourth scan lines SL41 and SL4*n* in response to the fourth gate start pulse GSP4. Each of the sub-scan drivers 131, 132, 133, and 134 may include a plurality of scan stages connected in the form of a shift register. For example, scan signals may be generated by sequentially transferring a pulse at the turn-on level of the gate start pulse GSP supplied to a scan start line to the next scan stage.

According to an embodiment, the second sub-scan driver 132 and the fourth sub-scan driver 134 may be composed of a single sub-scan driver. In this case, the second scan lines SL21 and SL2*n* and the fourth scan lines SL41 and SL4*n* may be connected to the same node, and the second gate start pulse GSP2 and the fourth gate start pulse GSP4 may be the same, and the second scan signal and the fourth scan signal may be the same. The sub-scan driver in which the second sub-scan driver 132 and the fourth sub-scan driver 134 are integrated may supply the scan signals to the scan lines SL21, SL41, SL2*n*, and SL4*n*.

In an embodiment, the fourth sub-scan driver 134 may be omitted according to a pixel structure of the pixel PXnm.

The scan signal may be set to a gate-on voltage (e.g., a pulse at the turn-on level) so that the transistor included in the pixel PXnm may be turned on.

In an embodiment, the scan signal may be a signal having a pulse of first polarity or a second polarity. At this time, the first polarity and the second polarity may be opposite polarities to each other.

Hereinafter, the polarity may be referred to a logic level of a pulse. For example, when the pulse is the first polarity, the pulse may have a high level. When the pulse of the first polarity is supplied to a gate electrode of the N-type transistor, the N-type transistor may be turned on. That is, the pulse of the first polarity may be a turn-on level for the N-type transistor. Here, it is assumed that a voltage of a sufficiently low level is applied to the source electrode of the N-type transistor compared to the gate electrode. For example, the N-type transistor may be an NMOS transistor.

In addition, when the pulse is the second polarity, the pulse may have a low level. When the pulse of the second polarity is supplied to a gate electrode of the P-type transistor, the P-type transistor may be turned on. That is, the pulse of the second polarity may be a turn-on level for the P-type transistor. Here, it is assumed that a voltage of a sufficiently high level is applied to the source electrode of the P-type transistor compared to the gate electrode. For example, the P-type transistor may be a PMOS transistor.

In an embodiment, the sensing unit 140 may receive a control signal from the timing controller 110 to supply an initialization voltage to the sensing lines including IL1, IL2, and ILk. Here, k may be a natural number, and may be the same as m described above but is not limited thereto. For example, k may be substantially equal to m in an embodiment having a shared sensing line ILk for pixel circuits PXC1 and PXC2 (see, e.g., FIG. 9). In an another embodiment, k may be substantially two times m where there are separate sensing lines such as ILk and ILk+1 for pixel circuit s PXC1 and PXC2.

The initialization voltage may be supplied to each of a plurality of pixels PXnm electrically connected to the sensing lines IL1, IL2, and ILk. In an embodiment, the initialization voltage VINT may be a voltage for initializing the anode and/or cathode of the light-emitting diode included in the pixel PXnm as may be further described below.

In an embodiment, the sensing unit 140 may receive a control signal from the timing controller 110 to receive a sensing signal through each of the sensing lines IL1, IL2, and ILk. For example, the sensing unit 140 may receive the sensing signals through the sensing lines IL1, IL2, and ILk during at least some periods of the sensing periods. The sensing unit 140 may be connected to the pixels PXnm through the sensing lines IL1, IL2, and ILk.

The sensing unit 140 may sense a sensing current, and may output the sensing value therefor to the compensator 150. Here, the sensing value (or sensing data) may be a digital value, and may indicate a sensing current value for the sensing current.

In an embodiment, the sensing unit 140 may sense sensing currents of only some pixels PXnm, or sensing currents of all pixels PXnm, during the sensing period depending on a control signal supplied from the timing controller 110, thereby outputting a sensing current value (or sensing current values) to the compensator 150.

The sensing unit 140 may include sensing channels connected to the sensing lines IL1, IL2, and ILk. For example, the sensing lines IL1, IL2, and ILk and the sensing channels may correspond one-to-one.

As shown in FIG. 8, the data driver 120 and the sensing unit 140 may be separately formed; but in an embodiment, the data driver 120 and the sensing unit 140 may be integrally formed.

The compensator 150 may calculate a current compensation value COMP for each of the pixels PXnm based on a sensing value (e.g., a sensing current value) output from the sensing unit 140, and may output the current compensation value COMP to the timing controller 110. For example, the compensator 150 may calculate the current compensation value COMP based on the sensing current value output from the sensing unit 140 and a predetermined reference current value known in advance, and may output the current compensation value COMP to the timing controller 110.

Here, the reference current value (or reference current data) may be a digital value of the current flowing through the pixel PXnm, and may mean an expected current value when reference grayscale data is input from an external source. The reference current value may be previously stored in a memory included in the display device 100 before shipment, or may be actively redefined during use of the product. The input grayscale value may be grayscale data input from an external processor, and may mean grayscale data for an image frame.

The display unit 160 includes pixels PXnm. For example, the pixel PXnm may be connected to the data line DLm, the scan lines SL1*n*, SL2*n*, SL3*n*, and SL4*n*, the sensing line ILk, the first power line PL1, and the second power line PL2 corresponding thereto. The pixels PXnm may receive the first data signal, or both the first data signal and the second data signal from the data driver 120, the scan signals from the scan driver 130, and the initialization voltage from the sensing unit 140, the first power voltage and the second power voltage (not shown) from the power supply 170.

In an embodiment of the present invention, signal lines SL1, SL2, SL3, SL4, DL, IL, PL1, and PL2 connected to the pixel PXnm may be variously set corresponding to the circuit structure of the pixel PXnm.

Corresponding to the circuit structure of pixels PXnm, the pixels PXnm disposed on the current horizontal line (or current pixel row) may be further connected to a scan line disposed on the previous horizontal line (or previous pixel row) and/or a scan line disposed on the next horizontal line (or next pixel row). For this purpose, the display unit 160 may further include dummy scan lines and/or dummy light emission control lines.

The compensator 150 may include a lookup table. The lookup table may exist in a data form, or in a physical form. In an embodiment, the lookup table may store compensation amount data corresponding to a sensing value, a variation in the sensing value, or the like in advance, before shipment of the display device 100. In another embodiment, the lookup table may update compensation amount data corresponding to a sensing value, a variation in the sensing value, or the like after shipment of the display device 100.

The power supply 170 may supply the power voltages to the power lines. For example, the power supply 170 may supply the first power voltage to the first power line and the second power voltage to the second power line.

The power voltage may be a first level or a second level lower than the first level. In an embodiment, when the first power voltage is the first level, the second power voltage may be the second level, and when the first power voltage is the second level, the second power voltage may be the first level.

In an embodiment, the power supply 170 may supply the first power voltage at the first level and the second power voltage at the second level during a first frame period, and may supply the first power voltage at the second level and the second power voltage at the first level during a second frame period.

Here, the first frame period may mean, for example a period corresponding to an odd numbered frame, and the second frame period may mean, for example a period corresponding to an even numbered frame. However, the embodiment is not limited thereto, and the first frame period may be a period corresponding to the even numbered frame and the second frame period may be a period corresponding to the odd numbered frame.

That is, the power supply 170 may alternately supply the level of the first power voltage and the level of the second power voltage for each frame.

In an embodiment, the power supply 170 may supply the first power voltage at the first level and the second power voltage at the second level regardless of the frame period.

In an embodiment, the power supply 170 may supply the first power voltage at the second level and the second power voltage at the first level regardless of the frame period.

In an embodiment, the power supply 170 may supply the first power voltage at the first level and the second power voltage at the second level; and then supply the first power voltage at the second level and the second power voltage at the first level, regardless of the frame period. In an another embodiment, one of the first or second power voltages may be maintained at a substantially same level, while the other of the first or second power voltages be switched between a voltage level higher than the one and a voltage level lower than the one, during a same period and/or regardless of the frame period.

The display device 100 may further include a memory.

Hereinafter, a pixel PXnm according to an embodiment of the present invention will be described.

FIG. 9 is a circuit diagram of a pixel according to an embodiment of the present invention.

In FIG. 9, for better understanding and ease of description, an embodiment of the present invention will be described with respect to a pixel PXnm (or first pixel) connected to an n-th horizontal line (e.g., the first scan line SL1*n*, second scan line SL2*n*, third scan line SL3*n*, and fourth scan line SL4*n*), a m-th data line DLm, and a k-th sensing line ILk.

Referring to FIG. 9, the pixel PXnm may include a first pixel circuit PXC1 and a second pixel circuit PXC2, light-emitting diodes LD1 and LD2, and the like.

The first pixel circuit PXC1 may drive the first light-emitting diode LD1. The first pixel circuit PXC1 may be connected to a first power line PL1, a first scan line SL1*n*, a second scan line SL2*n*, a data line DLm, a sensing line ILk, a first electrode such as an anode of a first light-emitting diode LD1, and a second electrode such as a cathode of a second light-emitting diode LD2.

The first pixel circuit PXC1 may include a first transistor Tr1, a second transistor Tr2, a third transistor Tr3, a first storage capacitor Cst1, and the like.

The first transistor Tr1 may control a driving current based on the first data signal in the first frame period. The first transistor Tr1 may be referred to as a driving transistor. A first electrode of the first transistor Tr1 may be connected to the first power line PL1, a second electrode of the first transistor Tr1 may be connected to a first node N1, and a gate electrode of the first transistor Tr1 may be connected to a second node N2.

In an embodiment, when the first power voltage applied to the first power line PL1 is the first level and the second power voltage applied to the second power line PL2 is the second level, the first transistor Tr1 may control an amount of the driving current flowing through the first power line PL1, the first transistor Tr1, the first light-emitting diode LD1, the fourth transistor Tr4, and the second power line PL2 corresponding to a voltage (e.g., the first data signal) of the second node N2. For this purpose, as described later with reference to FIGS. 10A and 10B, the first power voltage may be set to a higher voltage than the second power voltage in the first frame period (e.g., the odd numbered frame period).

The first transistor Tr1 may be turned on by a first data signal or a second data signal in the second frame period.

In an embodiment, when the first power voltage applied to the first power line PL1 is the second level and the second power voltage applied to the second power line PL2 is the first level, the first transistor Tr1 may be turned on by a voltage (e.g., the first data signal or second data signal) of the second node N2, and then a driving current may flow through the second power line PL2, the fourth transistor Tr4, the second light-emitting diode LD2, the first transistor Tr1, and the first power line PL1. For this purpose, as described later with reference to FIGS. 12A and 12*b*, the first power voltage may be set to a voltage lower than the second power voltage in the second frame period (e.g., the even numbered frame period).

The second transistor Tr2 may select a pixel PXnm to receive a first data signal (or first data signal and second data signal) based on the first scan signal supplied to the first scan line SL1*n*. That is, the second transistor Tr2 may electrically connect the data line DLm and the second node N2 based on the first scan signal supplied to the first scan line SL1*n*. The second transistor Tr2 may be referred to as a scanning transistor. The second transistor Tr2 may be connected between the data line DLm and the second node N2. That is, a first electrode of the second transistor Tr2 may be connected to the data line DLm, a second electrode of the second transistor Tr2 may be connected to the second node N2, and a gate electrode of the second transistor Tr2 may be connected to the first scan line SL1*n*. The second transistor Tr2 may be turned on when the first scan signal having a pulse of a turn-on level is supplied to the first scan line SL1*n* to electrically connect the data line DLm and the second node N2.

The third transistor Tr3 may be connected between the second electrode (e.g., the first node N1) of the first transistor Tr1 and the sensing line ILk. That is, a first electrode of the third transistor Tr3 may be connected to the first node N1, a second electrode of the third transistor Tr3 may be connected to the sensing line ILk, and a gate electrode of the third transistor Tr3 may be connected to the second scan line SL2*n*. The third transistor Tr3 may be turned on when the second scan signal having a pulse of a turn-on level is supplied to the second scan line SL2*n* to electrically connect the sensing line ILk and the first node N1. Meanwhile, when the third transistor Tr3 is turned on, an initialization voltage supplied to the sensing line ILk may be applied to the first node N1. When the initialization voltage is applied to the first node N1, the first electrode (e.g., the anode) of the first light-emitting diode LD1 and the second electrode (e.g., the cathode) of the second light-emitting diode LD2 may be initialized.

The first storage capacitor Cst1 may charge an amount of charge corresponding to a potential difference between a voltage applied to the first node N1 and a voltage applied to the second node N2. The first storage capacitor Cst1 may be connected between the first node N1 and the second node N2. Specifically, the first electrode of the first storage capacitor Cst1 may be connected to the first node N1, and the second electrode of the first storage capacitor Cst1 may be connected to the second node N2.

The second pixel circuit PXC2 may drive the second light-emitting diode LD2. The second pixel circuit PXC2 may be connected to the second power line PL2, the third scan line SL3*n*, the fourth scan line SL4*n*, the data line DLm, the sensing line ILk, the second electrode of the first light-emitting diode LD1, and the first electrode of the second light-emitting diode LD2.

The second pixel circuit PXC2 may include a fourth transistor Tr4, a fifth transistor Tr5, a sixth transistor Tr6, and a second storage capacitor Cst2.

The fourth transistor Tr4, in the second frame period, may control the driving current based on the first data signal. The fourth transistor Tr4 may be referred to as a driving transistor in the same manner as the first transistor Tr1. A first electrode of the fourth transistor Tr4 may be connected to the second power line PL2, a second electrode of the fourth transistor Tr4 may be connected to the third node N3, and a gate electrode of the fourth transistor Tr4 may be connected to the fourth node N4.

In an embodiment, when the first power voltage applied to the first power line PL1 is the second level and the second power voltage applied to the second power line PL2 is the first level, the fourth transistor Tr4 may control an amount of the driving current flowing to the second power line PL2, the fourth transistor Tr4, the second light-emitting diode LD2, the first transistor Tr1, and the first power line PL1 corresponding to a voltage (e.g., the first data signal) of the fourth node N4. For this purpose, as described later with reference to FIGS. 12A and 12B, the second power voltage may be set to a higher voltage than the first power voltage in the second frame period (e.g., an even numbered frame period).

The fourth transistor Tr4 may be turned on by the first data signal or the second data signal in the first frame period.

In an embodiment, when the first power voltage applied to the first power line PL1 is the first level and the second power voltage applied to the second power line PL2 is the second level, the fourth transistor Tr4 may be turned on by a voltage (e.g., the first data signal or second data signal) of the fourth node N4, and then the driving current may flow to the first power line PL1, the first transistor Tr1, the first light-emitting diode LD1, the fourth transistor Tr4, and the second power line PL2. For this purpose, as described later with reference to FIGS. 12A and 12B, the first power voltage may be set to a higher voltage than the second power voltage in the first frame period (e.g., an odd numbered frame period).

The fifth transistor Tr5 may select a pixel PXnm to receive the first data signal (or first data signal and second data signal) based on the third scan signal supplied to the third scan line SL3*n*. That is, the fifth transistor Tr5 may electrically connect the data line DLm and the fourth node N4 based on the third scan signal supplied to the third scan line SL3*n*. The fifth transistor Tr5 may be referred to as a scanning transistor in the same manner as the second transistor Tr2. The fifth transistor Tr5 may be connected between the data line DLm and the fourth node N4. That is, a first electrode of the fifth transistor Tr5 may be connected to the data line DLm, a second electrode of the fifth transistor Tr5 may be connected to the fourth node N4, and a gate electrode of the fifth transistor Tr5 may be connected to the third scan line SL3*n*. The fifth transistor Tr5 may be turned on when the third scan signal having a pulse of a turn-on level is supplied to the third scan line SL3*n* to electrically connect the data line DLm and the fourth node N4.

The sixth transistor Tr6 may be connected between the second electrode (e.g., the third node N3) of the fourth transistor Tr4 and the sensing line ILk. That is, a first electrode of the sixth transistor Tr6 may be connected to the third node N3, a second electrode of the sixth transistor Tr6 may be connected to the sensing line ILk, and a gate electrode of the sixth transistor Tr6 may be connected to the fourth scan line SL4*n*. The sixth transistor Tr6 may be turned on when the fourth scan signal having a pulse of a turn-on level is supplied to the fourth scan line SL4*n* to electrically connect the sensing line ILk and the third node N3. On the other hand, when the sixth transistor Tr6 is turned on, the initialization voltage supplied to the sensing line ILk may be applied to the third node N3. When the initialization voltage is applied to the third node N3, the second electrode (e.g., the cathode) of the first light-emitting diode LD1 and the first electrode (e.g., the anode) of the second light-emitting diode LD2 may be initialized.

In an embodiment, the initialization voltage may be a voltage having a low level, without limitation thereto.

The second storage capacitor Cst2 may charge an amount of charge corresponding to a potential difference between a voltage applied to the third node N3 and a voltage applied to the fourth node N4. The second storage capacitor Cst2 may be connected between the third node N3 and the fourth node N4. Specifically, a first electrode of the second storage capacitor Cst2 may be connected to the third node N3, and a second electrode of the second storage capacitor Cst2 may be connected to the fourth node N4.

The first electrode of the first light-emitting diode LD1 may be connected to the first pixel circuit PXC1, and the second electrode of the first light-emitting diode LD1 may be connected to the second pixel circuit PXC2. Specifically, the first electrode (e.g., the anode) of the first light-emitting diode LD1 may be connected to the first node N1, and the second electrode (e.g., the cathode) of the first light-emitting diode LD1 may be connected to the third node N3. The first light-emitting diode LD1 may emit light with predetermined luminance corresponding to an amount of current supplied from the first transistor Tr1.

In an embodiment, the first light-emitting diode LD1 may be a light-emitting diode shown in FIGS. 1 to 7.

In an embodiment, the number of the first light-emitting diode LD1 may be one, but is not limited thereto, and a plurality of first light-emitting diodes LD1 may be connected in parallel and/or in series between the first node N1 and the third node N3.

As shown in FIG. 9, a state in which the first electrode of the first light-emitting diode LD1 is connected to the first node N1 and the second electrode of the first light-emitting diode LD1 is connected to the third node N3 will be referred to as an alignment state of the light-emitting diode aligned in a forward direction (or first direction).

The first electrode of the second light-emitting diode LD2 may be connected to the second pixel circuit PXC2, and the second electrode of the second light-emitting diode LD2 may be connected to the first pixel circuit PXC1. Specifically, the first electrode (e.g., the anode) of the second light-emitting diode LD2 may be connected to the third node N3, and the second electrode (e.g., the cathode) of the second light-emitting diode LD2 may be connected to the first node N1. The second light-emitting diode LD2 may emit light with predetermined luminance corresponding to an amount of the current supplied from the fourth transistor Tr4.

In an embodiment, the second light-emitting diode LD2 may be a light-emitting diode shown in FIGS. 1 to 7.

In an embodiment, the number of the second light-emitting diode LD2 may be one, but is not limited thereto, and a plurality of second light-emitting diode LD2 may be connected in parallel and/or in series between the first node N1 and the third node N3.

As shown in FIG. 9, a state in which the first electrode of the second light-emitting diode LD2 is connected to the third node N3 and the second electrode of the second light-emitting diode LD2 is connected to the first node N1 will be referred to as an alignment state of the light-emitting diode aligned in a reverse direction (or second direction).

In an embodiment, during the first frame period, the first power voltage supplied to the first power line PL1 may be the first level, and the second power voltage supplied to the second power line PL2 may be the second level. For example, during the odd numbered frame period, the first power voltage may be higher than the second power voltage.

In an embodiment, during the second frame period, the first power voltage supplied to the first power line PL1 may be the second level, and the second power voltage supplied to the second power line PL2 may be the first level. For example, during an even numbered frame period, the first power voltage may be lower than the second power voltage.

When the initialization voltage is supplied to the first and second electrodes of the light-emitting diodes LD1 and LD2, a parasitic capacitor of each of the light-emitting diodes LD1 and LD2 may be discharged. As a residual voltage charged in the parasitic capacitor is discharged (removed), unintentional fine light emission may be prevented. Therefore, black display ability of the pixel PXnm may be improved.

In an embodiment, transistors Tr1 to Tr6 may be composed of N-type transistors, may be composed of P-type transistors, or may be composed of a combination of N-type transistors and P-type transistors. Here, the N-type transistor is a transistor in which the amount of the current to be conducted increases when a voltage difference between the gate electrode and the source electrode increases in a positive direction. The P-type transistor is a transistor in which the amount of the current to be conducted increases when a voltage difference between the gate electrode and the source electrode increases in a negative direction.

For example, transistors Tr1 to Tr6, as shown in FIG. 9, may be N-type transistors. However, the embodiment is not limited thereto.

In an embodiment, the transistor may be an oxide semiconductor transistor, an amorphous semiconductor transistor and/or polysilicon semiconductor transistor.

When the light-emitting diodes LD1 and LD2 are composed of the light-emitting diodes LD1 and LD2 shown in FIGS. 1 to 7, the light-emitting diodes LD1 and LD2, as shown in FIG. 9, may be arranged in the forward direction (or first direction) or the reverse direction (or second direction). In a case where the first power voltage supplied to the first power line PL1 is maintained at the first level and the second power voltage supplied to the second power line PL2 is maintained at the second level, only the light-emitting diode (e.g., the first light-emitting diode LD1 aligned in the forward direction or first direction), aligned in a specific direction among the light-emitting diodes LD1 and LD2, emits light, and the light-emitting diode (e.g., the second light-emitting diode LD2 aligned in the reverse direction or second direction), aligned in the other direction, does not emit light. In this case, the cost of the manufacturing process is increased due to the second light-emitting diode LD2 that cannot emit light and life-span of the first light-emitting diode LD1 is shortened by emitting only the first light-emitting diode LD1.

A pixel PXnm and a display device 100 including the same according to an embodiment of the present invention may use the first transistor Tr1 to the sixth transistor Tr6 and may alternately switch a level of the first power voltage and a level of the second power voltage for each frame, thereby emitting all light-emitting diodes LD included in the pixel PXnm regardless of the alignment direction. Therefore, the luminance of the display device 100 may be improved, and the life-span of the light-emitting diodes LD may be increased.

Hereinafter, the power supply shown in FIG. 8 and the driving method of the pixel shown in FIG. 9 will be described in detail using a timing diagram.

Figure 10A:
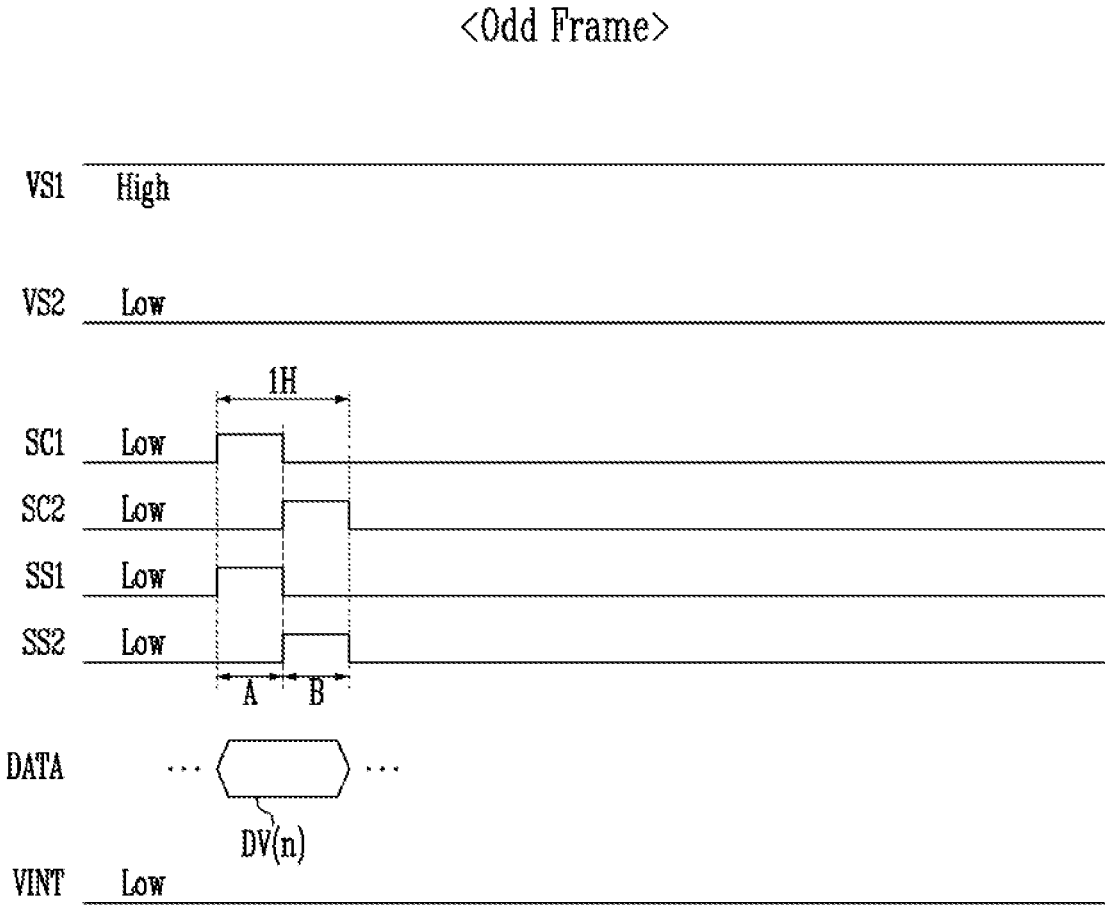
FIGS. 10A and 10B are timing diagrams for illustrating operation of a power supply shown in FIG. 8 and a driving method of a pixel shown in FIG. 9.
Figure 10B:
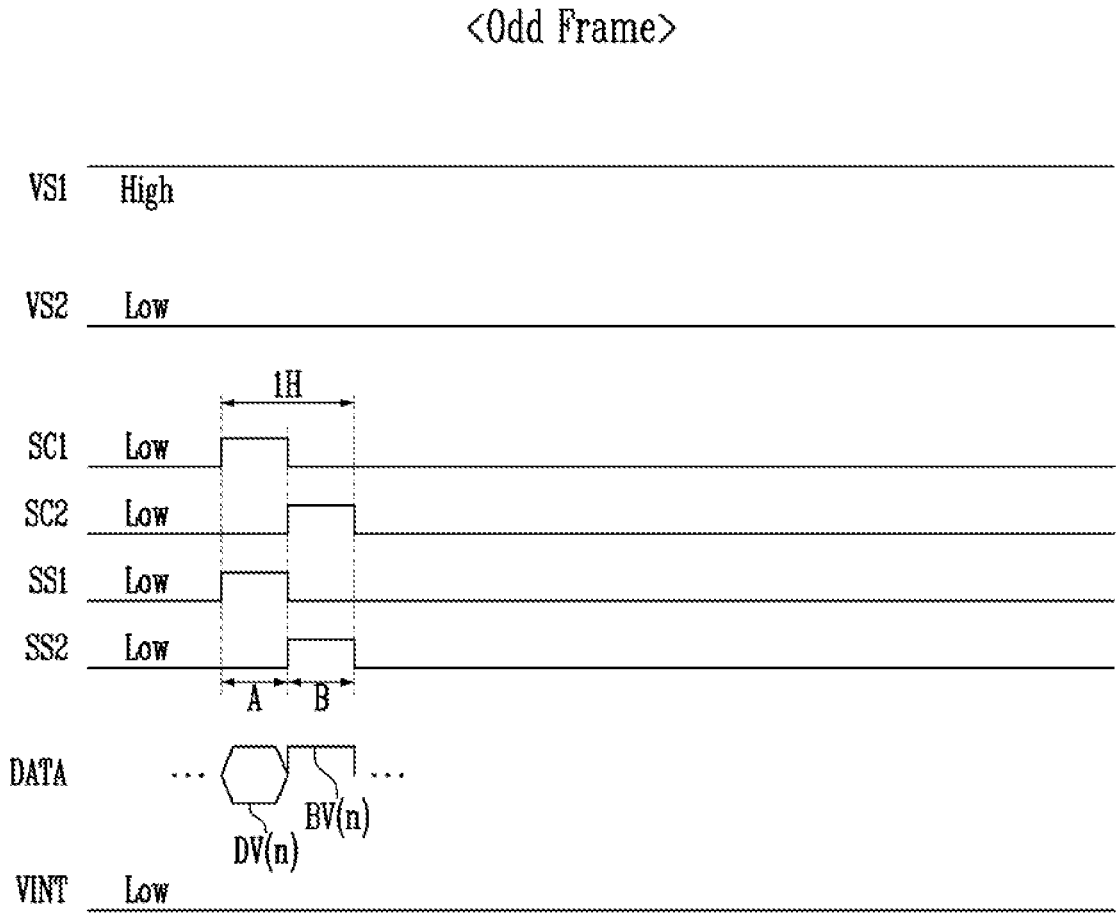
Figure 11A:
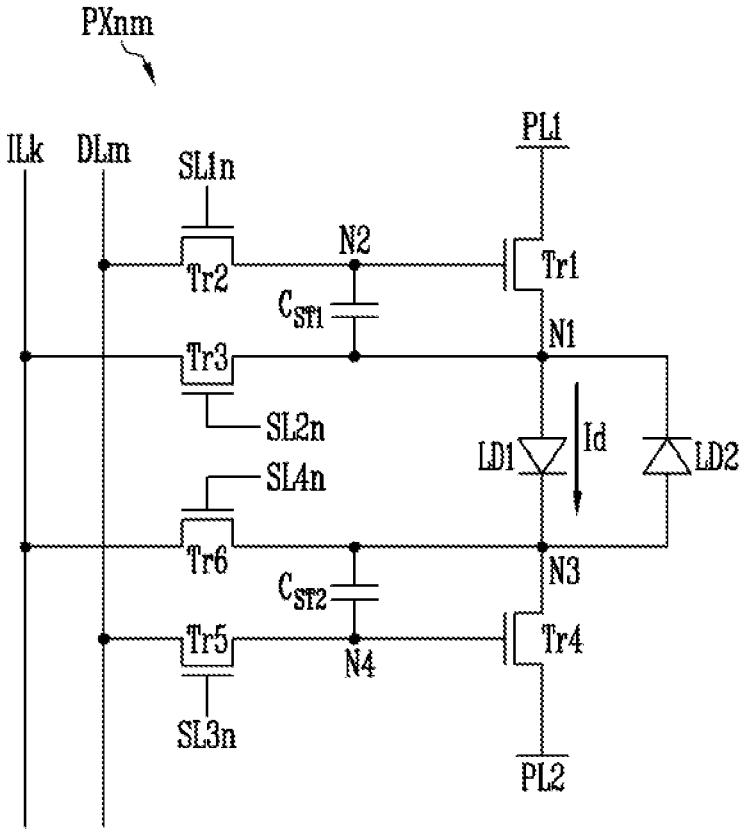
FIGS. 11A and 11B are circuit and schematic diagrams showing an embodiment in which a pixel shown in FIG. 9 emits light according a driving method shown in FIGS. 10A and 10B.
Figure 11B:
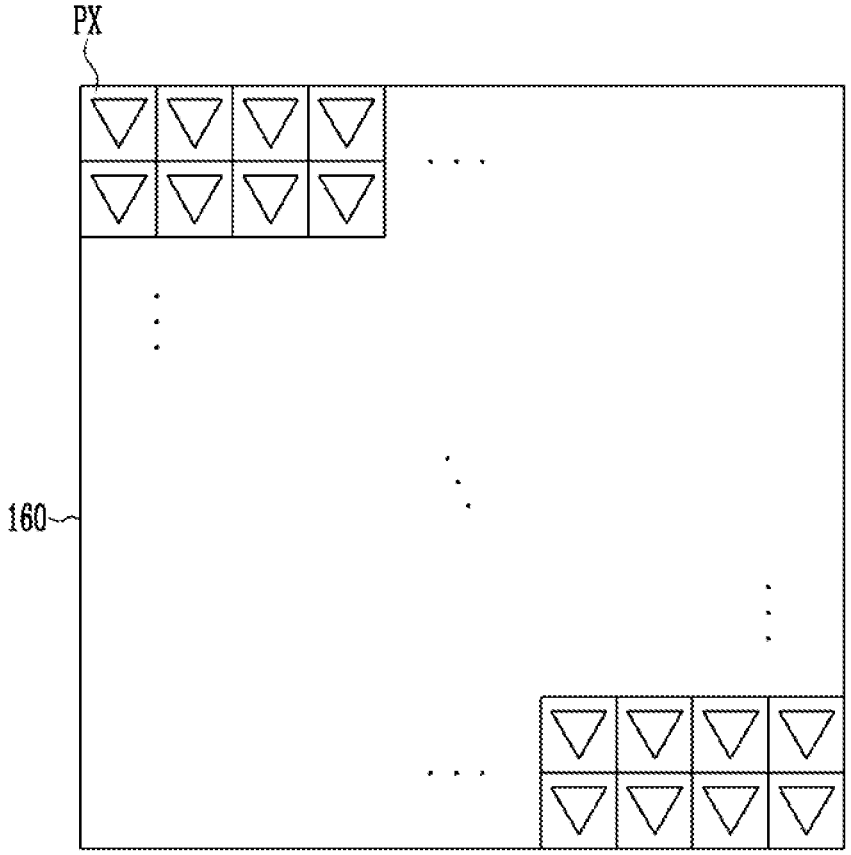

FIGS. 10A and 10B are timing diagrams for illustrating a power supply shown in FIG. 8 and a driving method of a pixel shown in FIG. 9, and FIGS. 11A and 11B are drawings showing an embodiment in which a pixel shown in FIG. 9 emits light according a driving method shown in FIGS. 10A and 10B.

In FIGS. 10A, 10B, and 11A, for better understanding and ease of description, a driving method of a pixel PXnm will be described with respect to the pixel PXnm which is disposed on the n-th horizontal line and is connected to the m-th data line DLm and the k-th sensing line ILk.

In addition, in FIGS. 10A, 10B, 11A, and 11B, a driving method of the power supply 170 and the pixel PXnm in the first frame period, for example, an odd numbered frame period, will be described.

In an embodiment, a voltage of the turn-on level of the first scan signal SC1, the second scan signal SS1, the third scan signal SC2, and the fourth scan signal SS2 may be defined as a voltage having a high level. However, the embodiment is exemplary, and voltage levels and/or pulse-widths of the scan signals SC1, SC2, SS1, and SS2 are not limited thereto, and may be changed depending on pixel structure, type of transistors, and the like.

In an another embodiment where first scan signal SC1 is the same as second scan signal SS1, and the third scan signal SC2 is the same as the fourth scan signal SS2, the second sub-scan driver 132 and the fourth sub-scan driver 134 may be omitted.

Referring to FIG. 10A, during the odd numbered frame period, the power supply 170 may supply a first power voltage VS1 at the first level to a first power line PL1 and a second power voltage VS2 at the second level to a second power line PL2.

For example, during the odd numbered frame period, the first power voltage VS1 at a high level may be supplied to the first power line PL1, and the second power voltage VS2 at a low level may be supplied to the second power line PL2.

The first sub-scan driver 131 may supply the first scan signal SC1 at the turn-on level to the first scan line SL1*n* during the first period A in 1 horizontal period 1H.

When the first scan signal SC1 is supplied, the second transistor Tr2 is turned on by the first scan signal SC1. When the second transistor Tr2 is turned on, the n-th row's first data signal DV(n) is applied to the second node N2 through the data line DLm.

The second sub-scan driver 132 may supply the second scan signal SS1 at the turn-on level to the second scan line SL2*n* during the first period A in 1 horizontal period 1H.

In an embodiment, the second scan signal SS1 may be supplied in synchronization at the time when the first scan signal SC1 at the turn-on level is supplied.

When the second scan signal SS1 is supplied, the third transistor Tr3 is turned on by the second scan signal SS1. When the third transistor Tr3 is turned on, the initialization voltage VINT is applied to the first node N1 through the sensing line ILk. When the initialization voltage VINT is applied to the first node N1, the first electrode of the first light-emitting diode LD1 and the second electrode of the second light-emitting diode LD2 are initialized. At this time, the initialization voltage VINT may be, for example, a second level. In an embodiment, the initialization voltage VINT may be a low level.

During the first period A, the initialization voltage is applied to the first electrode of the first storage capacitor Cst1, and the first data signal DV(n) is applied to the second electrode of the first storage capacitor Cst1. Accordingly, a difference voltage corresponding to the difference between the first data signal DV(n) and the initialization voltage is charged in the first storage capacitor Cst1.

The third sub-scan driver 133 may supply the third scan signal SC2 at the turn-on level to the third scan line SL3*n* during the second period B in 1 horizontal period 1H.

When the third scan signal SC2 is supplied, the fifth transistor Tr5 is turned on by the third scan signal SC2. When the fifth transistor Tr5 is turned on, the n-th first data signal DV(n) is applied to the fourth node N4 through the data line DLm.

The fourth sub-scan driver 134 may supply the fourth scan signal SS2 at the turn-on level to the fourth scan line SL4*n* during the second period B in 1 horizontal period 1H.

In an embodiment, the fourth scan signal SS2 may be supplied in synchronization at the time when the third scan signal SC2 at the turn-on level is supplied.

When the fourth scan signal SS2 is supplied, the sixth transistor Tr6 is turned on by the fourth scan signal SS2. When the sixth transistor Tr6 is turned on, the initialization voltage VINT is applied to the third node N3 through the sensing line ILk. When the initialization voltage VINT is applied to the third node N3, the second electrode of the first light-emitting diode LD1 and the first electrode of the second light-emitting diode LD2 are initialized. At this time, the initialization voltage VINT may be, for example, a second level. In an embodiment, the initialization voltage VINT may be a low level.

During the second period B, the initialization voltage VINT is applied to the first electrode of the second storage capacitor Cst2, and the first data signal DV(n) is applied to the second electrode of the second storage capacitor Cst2. Accordingly, the difference voltage corresponding to the difference between the first data signal DV(n) and the initialization voltage VINT is charged in the second storage capacitor Cst2. In an embodiment, 1 horizontal period 1H may mean a period from the first period A to the second period B.

In an embodiment, the first period A and the second period B may not overlap each other. In addition, a time interval of the first period A and a time interval of the second period B may be the same as shown in FIG. 10A, but is not limited thereto. Unlike shown in FIG. 10A, the sum of the first period A and the second period B may maintain 1 horizontal period, but the time interval of the first period A may be increased and the time interval of the second period B may be decreased, or the time interval of the first period A may be decreased and the time interval of the second period B may be increased.

Referring to FIGS. 10A and 11A, during the odd numbered frame period, the first power voltage VS1 supplied to the first power line PL1 is set higher than the second power voltage VS2 supplied to the second power line PL2. In addition, the first transistor Tr1 is turned on by the first data signal DV(n) stored in the first storage capacitor Cst1 during the first period A, and the fourth transistor Tr4 is turned on by the first data signal DV(n) stored in the second storage capacitor Cst2 during the second period B. When the first transistor Tr1 and the fourth transistor Tr4 are turned on and the first power voltage VS1 is set higher than the second power voltage VS2, the driving current Id may flow through the first light-emitting diode LD1 and not flow through the second light-emitting diode LD2. At this time, only the first light-emitting diode LD1 of the first light-emitting diode LD1 and the second light-emitting diode LD2 emits light after the second period B.

Therefore, referring to FIGS. 11A and 11B, in the first frame period (e.g., an odd numbered frame period), at least one light-emitting diode (e.g., the first light-emitting diode LD1), aligned in the forward direction among the light-emitting diodes included in each of a plurality of pixels PX included in the display unit 160, may emit light.

Referring to FIG. 10B, the embodiment shown in FIG. 10B is similar to the embodiment described above with reference to FIG. 10A, but is different from the embodiment described above with reference to FIG. 10A in that an n-th second data signal BV(n) instead of the n-th first data signal DV(n) is applied to the fourth node N4 during the second period B when the third scan signal SC2 is supplied. Here, the n-th second data signal BV(n) may be a voltage for turning on the driving transistor (e.g., the fourth transistor Tr4), and may mean a voltage such that equivalent resistance of the turned-on driving transistor (e.g., the fourth transistor Tr4) may have a minimum value.

Specifically, during the second period B in FIG. 10B, the difference voltage between the initialization voltage VINT and the second data signal BV(n) is charged in the second storage capacitor Cst2. Here, the second data signal BV(n) is set so that the fourth transistor Tr4 may be turned on, so the fourth transistor Tr4 may be stably turned on after the second period B.

Referring to FIGS. 10B, 11A, and 11B, as described above with reference to FIGS. 10A, 11A, and 11B, in the first frame period (e.g., an odd numbered frame period), only the first light-emitting diode LD1 among the first light-emitting diode LD1 and the second light-emitting diode LD2 may emit light, and at least one light-emitting diode (e.g., the first light-emitting diode LD1), aligned in the forward direction among the light-emitting diodes included in each of a plurality of pixels PX included in the display unit 160, may emit light.

According to FIG. 10B, the driving current Id corresponding to the n-th first data signal DV(n) stably flows in the pixel PXnm, so that a desired grayscale value, luminance, and the like may be more accurately displayed.

Figure 12A:
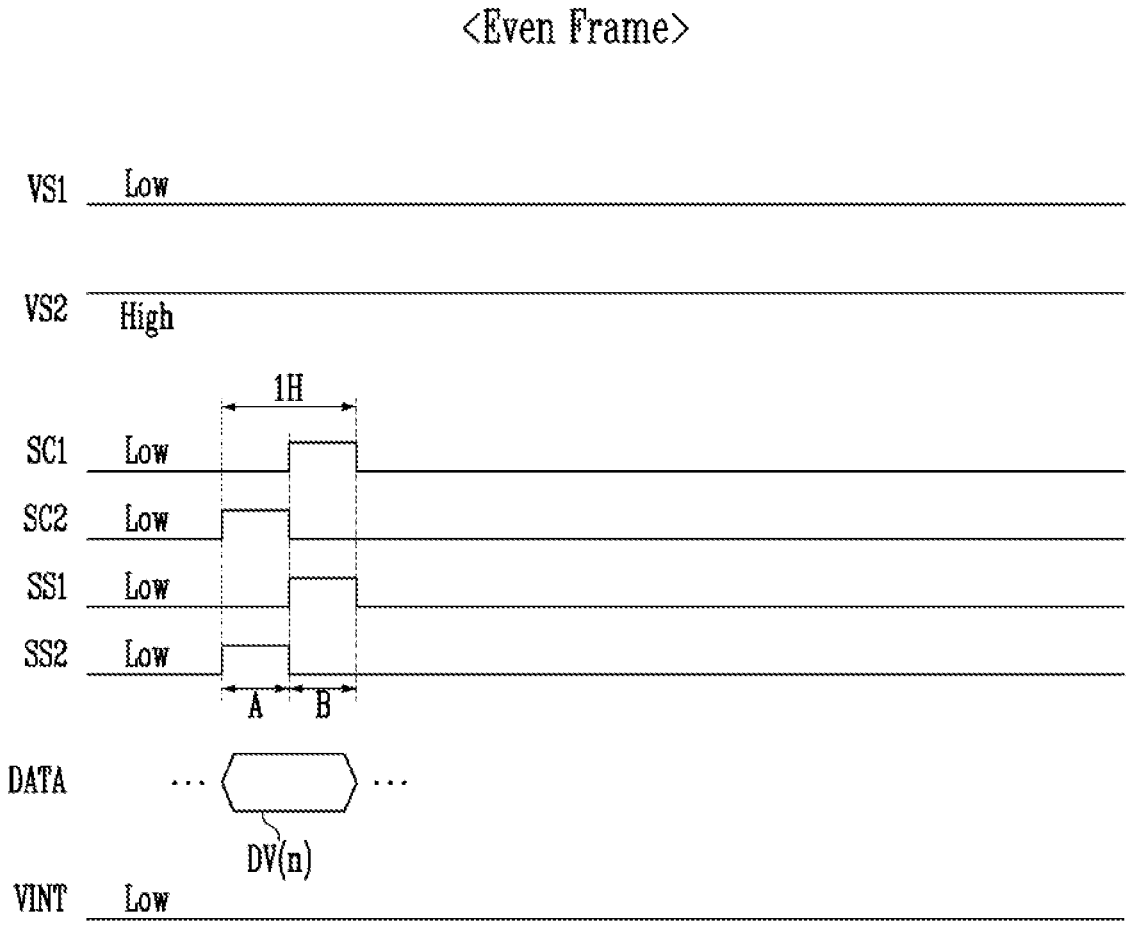
FIGS. 12A and 12B are timing diagrams for illustrating operation of a power supply shown in FIG. 8 and a driving method of a pixel shown in FIG. 9.
Figure 12B:
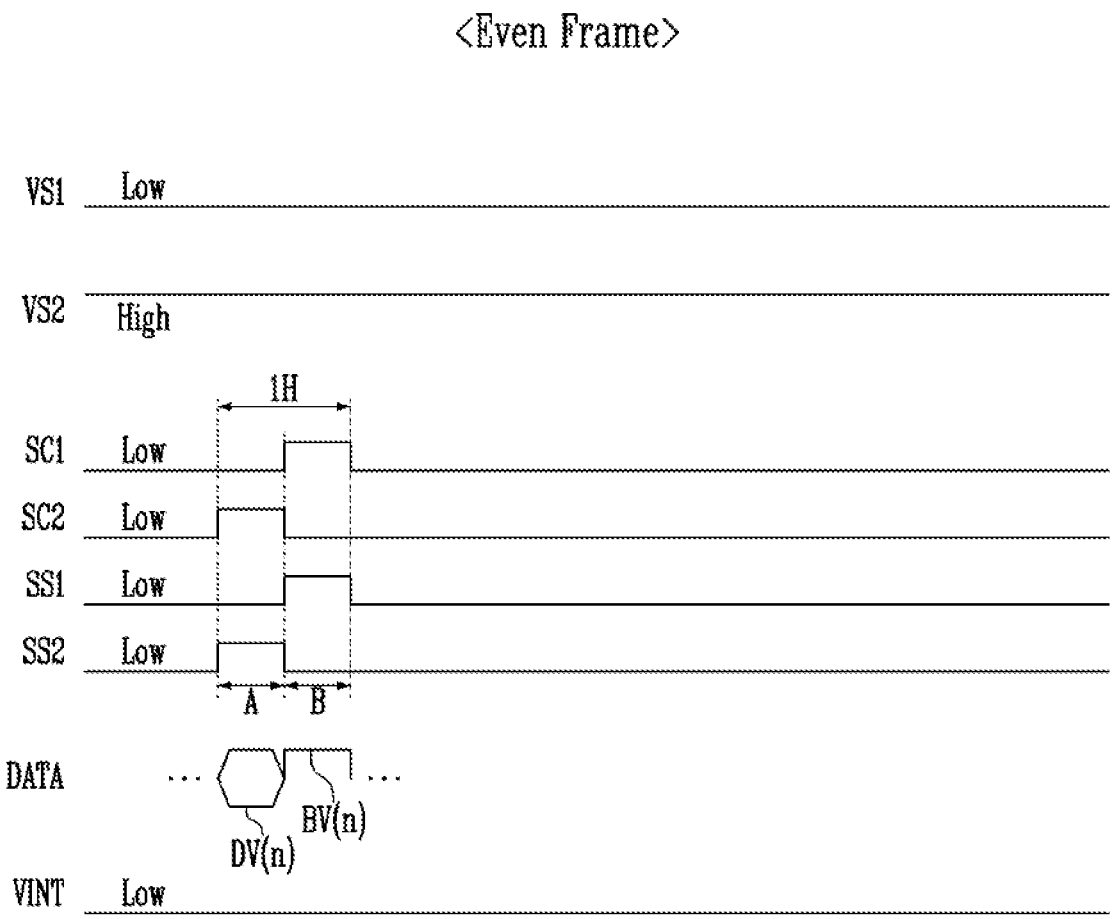
Figure 13A:
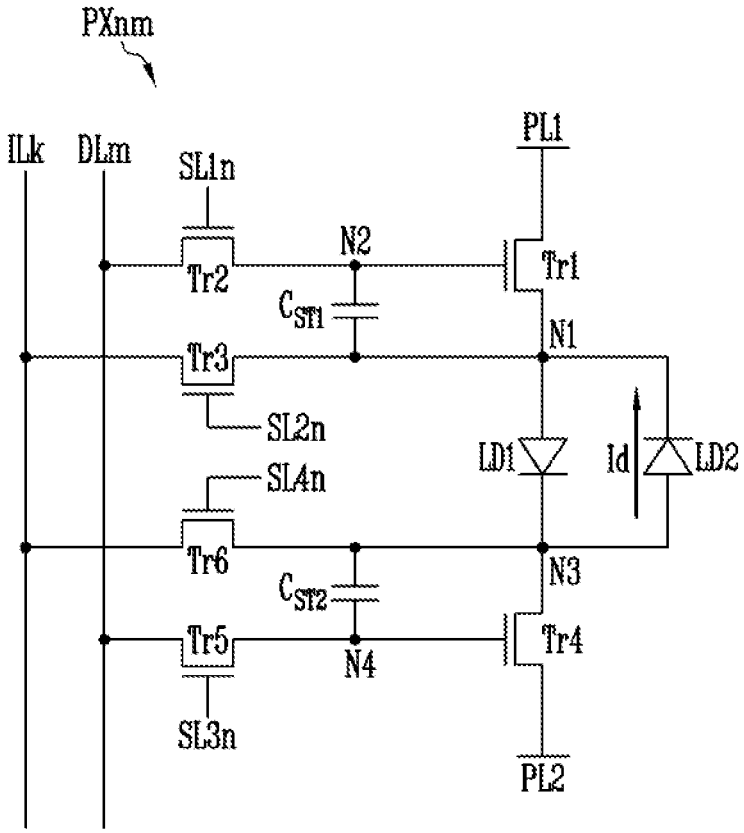
FIGS. 13A and 13B are circuit and schematic diagrams showing an embodiment in which a pixel shown in FIG. 9 emits light according a driving method shown in FIGS. 12A and 12B.
Figure 13B:
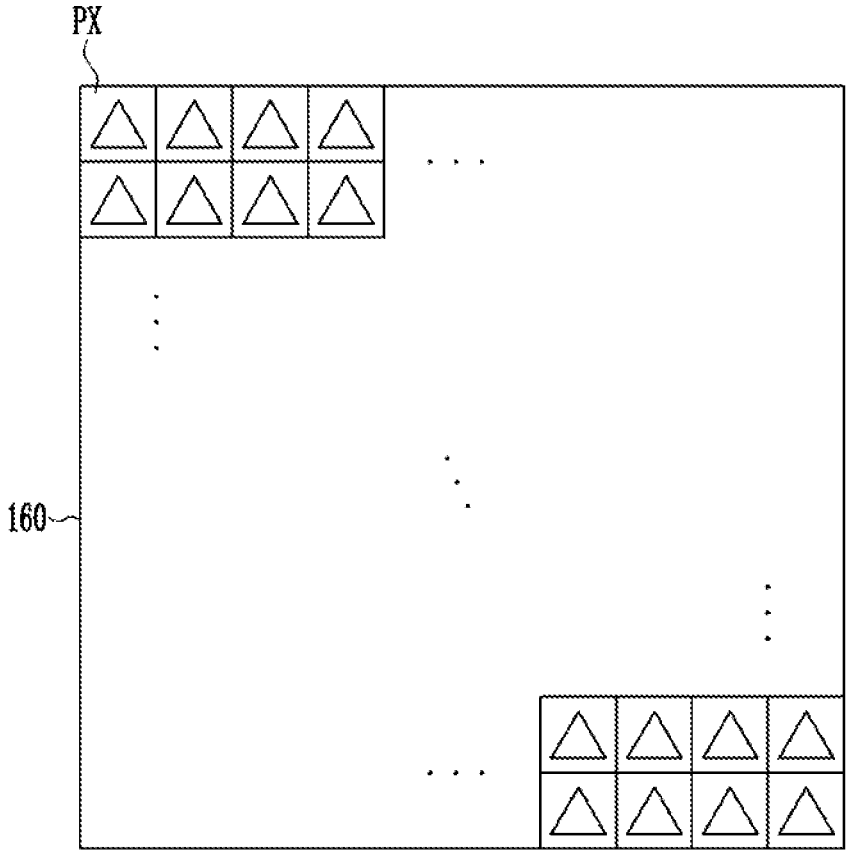

FIGS. 12A and 12B are timing diagrams for illustrating a power supply shown in FIG. 8 and a driving method of a pixel shown in FIG. 9, and FIGS. 13A and 13B are drawings showing an embodiment in which a pixel shown in FIG. 9 emits light according a driving method shown in FIGS. 12A and 12B.

In FIGS. 12A, 12B, and 13A, as in FIGS. 10A, 10B, and 11A, for better understanding and ease of description, a driving method of a pixel PXnm will be described with reference to the pixel PXnm which is disposed on the n-th horizontal line and is connected to the m-th data line DLm and the k-th sensing line ILk, and a driving method of the power supply 170 and the pixel PXnm in the second frame period, for example, an even numbered frame period will be described.

In addition, in describing the embodiment shown in FIGS. 12A, 12B, and 13A, the description for the same thing as shown in FIGS. 10A, 10B, and 11A will be omitted.

In an embodiment, a voltage at the turn-on level of the first scan signal SC1, the second scan signal SS1, the third scan signal SC2, and the fourth scan signal SS2 may be defined as a voltage having a high level. However, the embodiment is not limited thereto.

Referring to FIG. 12A, during the even numbered frame period, the power supply 170 supplies the first power voltage VS1 at the second level to the first power line PL1 and the second power voltage VS2 at the first level to the second power line PL2.

For example, during the even numbered frame period, the first power voltage VS1 at the low level is supplied to the first power line PL1, and the second power voltage VS2 at the high level is supplied to the second power line PL2.

The third sub-scan driver 133 may supply the third scan signal SC2 at the turn-on level to the third scan line SL3*n* during the first period A in 1 horizontal period 1H. When the third scan signal SC2 is supplied, the fifth transistor Tr5 is turned on, and then the n-th first data signal DV(n) is applied to the fourth node N4 through the data line DLm.

The fourth sub-scan driver 134 may supply the fourth scan signal SS2 at the turn-on level to the fourth scan line SL4*n* during the first period A in 1 horizontal period 1H. When the fourth scan signal SS2 is supplied, the sixth transistor Tr6 is turned on, and then the initialization voltage VINT is applied to the third node N3. When the initialization voltage VINT is applied to the third node N3, the second electrode of the first light-emitting diode LD1 and the first electrode of the second light-emitting diode LD2 are initialized. At this time, the initialization voltage VINT may be, for example, a second level.

During the first period A, the initialization voltage VINT is applied to the first electrode of the second storage capacitor Cs2, and the first data signal DV(n) is applied to the second electrode of the second storage capacitor Cst2. Accordingly, a difference voltage corresponding to the difference between the first data signal DV(n) and the initialization voltage is charged in the first storage capacitor Cst1.

The first sub-scan driver 131 may supply the first scan signal SC1 at the turn-on level to the first scan line SL1*n* during the second period B in 1 horizontal period 1H. When the first scan signal SC1 is supplied, the second transistor Tr2 is turned on, and then the n-th first data signal DV(n) is applied to the second node N2 through the data line DLm.

The second sub-scan driver 132 may supply the second scan signal SS1 at the turn-on level to the second scan line SL2*n* during the second period B in 1 horizontal period 1H. When the second scan signal SS1 is supplied, the third transistor Tr3 is turned on, and then the initialization voltage VINT is applied to the first node N1. When the initialization voltage VINT is applied to the first node N1, the first electrode of the first light-emitting diode LD1 and the second electrode of the second light-emitting diode LD2 are initialized. At this time, the initialization voltage VINT may be, for example, a second level.

During the second period B, the initialization voltage VINT is applied to the first electrode of the first storage capacitor Cst1, and the first data signal DV(n) is applied to the second electrode of the first storage capacitor Cst1. Accordingly, a difference voltage corresponding to the difference between the first data signal DV(n) and the initialization voltage VINT is charged in the first storage capacitor Cst1.

Referring to FIGS. 12A and 13A, during the even numbered frame period, the first power voltage VS1 supplied to the first power line PL1 is set lower than the second power voltage VS2 supplied to the second power line PL2. Then, the fourth transistor Tr4 is turned on by the first data signal DV(n) stored in the second storage capacitor Cst2 during the first period A, and the first transistor Tr1 is turned on by the first data signal DV(n) stored in the first storage capacitor Cst1 during the second period B. When the first transistor Tr1 and the fourth transistor Tr4 are turned on and the first power voltage VS1 is set lower than the second power voltage VS2, the driving current Id may flow through the second light-emitting diode LD2 and not flow through the first light-emitting diode LD1. At this time, only the second light-emitting diode LD2 of the first light-emitting diode LD1 and the second light-emitting diode LD2 emits light after the second period B.

Therefore, referring to FIGS. 13A and 13B, in the second frame period (e.g., an even numbered frame period), at least one light-emitting diode (e.g., the second light-emitting diode LD2), aligned in the reverse direction (or second direction) among the light-emitting diodes included in each of a plurality of pixels PX included in the display unit 160, may emit light.

Referring to FIG. 12B, the embodiment shown in FIG. 12B is similar to the embodiment described above with reference to FIG. 12A, but is different from the embodiment described above with reference to FIG. 10A in that an n-th second data signal BV(n) instead of the n-th first data signal DV(n) is applied to the second node N2 during the second period B when the first scan signal SC1 is supplied. Here, the n-th second data signal BV(n) may be a voltage for turning on the driving transistor (e.g., the first transistor Tr1), and may mean a voltage such that equivalent resistance of the turned-on driving transistor (e.g., the first transistor Tr1) may have a minimum value.

Specifically, during the second period B in FIG. 12B, the difference voltage between the initialization voltage VINT and the second data signal BV(n) is charged in the first storage capacitor Cst1. Here, the second data signal BV(n) is set so that the first transistor Tr1 may be turned on, so the first transistor Tr1 may be stably turned on after the second period B. In an another embodiment, the second data signal BV(n) is set so that the first transistor Tr1 may be turned off, so the first transistor Tr1 may be stably turned off after the second period B.

Referring to FIGS. 12B, 13A, and 13B, as described above with reference to FIGS. 12A, 13A, and 13B, in the second frame period (e.g., an even numbered frame period), only the second light-emitting diode LD2 among the first light-emitting diode LD1 and the second light-emitting diode LD2 may substantially emit light, and at least one light-emitting diode (e.g., the second light-emitting diode LD2), aligned in the reverse direction (or second direction) among the light-emitting diodes included in each of a plurality of pixels PX included in the display unit 160, may substantially emit light.

According to FIG. 12B, the driving current Id corresponding to the n-th first data signal DV(n) stably flows in the pixel PXnm, so that the desired grayscale value, luminance, and the like may be more accurately displayed.

According to the above, a display device is capable of driving all light-emitting diodes included in a pixel by alternately switching the level of the first power voltage and the level of the second power voltage for each frame.

In addition, luminance and life-span of the light-emitting diode may be increased by driving all light-emitting diodes.

Figure 14:
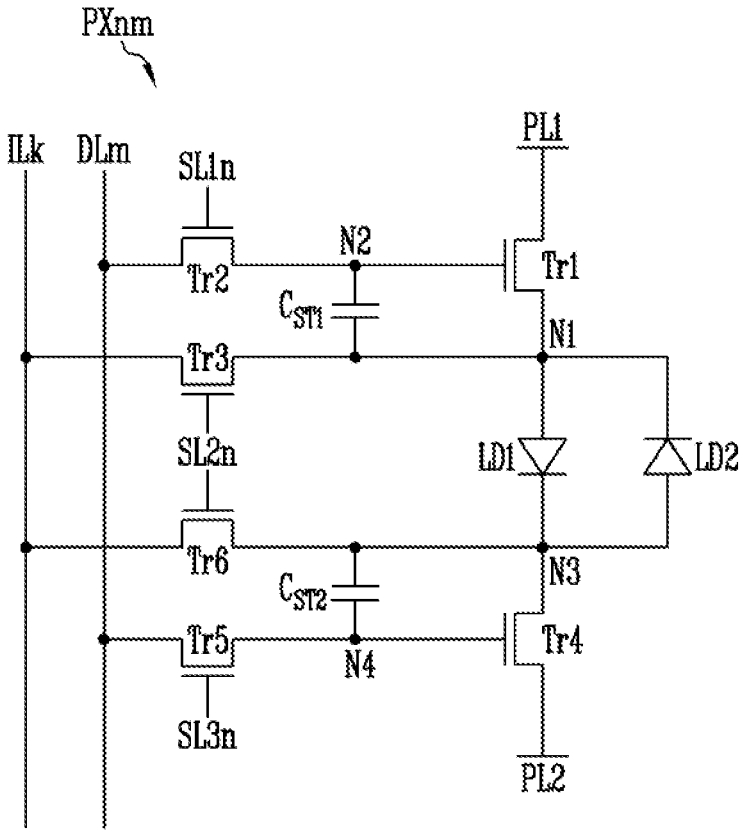
FIG. 14 is a circuit diagram for a modified embodiment of a pixel shown in FIG. 9.

FIG. 14 is a modified embodiment of a pixel shown in FIG. 9.

In describing the pixel PXnm shown in FIG. 14, the description will be omitted for the same configuration as that shown in FIG. 9, and the description will be focused on the difference.

Referring to FIGS. 9 and 14, as described above with reference to FIG. 1, since the second sub-scan driver 132 and the fourth sub-scan driver 134 may be composed of a single sub-scan driver, the second scan line SL2*n* and the fourth scan line SL4*n* shown in FIG. 9 may be integrated into one scan line, for example, the second scan line SL2*n* shown in FIG. 14. In addition, the second scan signal SS1 and the fourth scan signal SS2 may be the same. According to the above, it is possible to reduce the manufacturing cost by not adding a scan line, and to further reduce power consumption by not adding a scan signal.

In an another embodiment, a display panel includes a data driver connected to a first plurality of data lines; and a first plurality of pixels each connected to a corresponding one of the first plurality of data lines, respectively, and to a pair of switchable polarity power lines, wherein each of the first plurality of pixels includes a first light-emitting diode arranged with a first polarity, and a second light-emitting diode disposed in parallel with the first light-emitting diode and arranged with a second polarity opposite to the first polarity.

In an another embodiment display panel, each of the plurality of pixels may further include a first circuit for driving the first light-emitting diode; and a second circuit for driving the second light-emitting diode, wherein the data driver supplies a first data signal through a first of the first plurality of data lines to the first circuit, and supplies a second data signal through the first of the first plurality of data lines to the second circuit during a same frame period.

Hereinafter, a driving method of the pixel shown in FIG. 14 will be described with respect to the second scan line SL2*n* and the second scan signal SS1.

Figure 15A:
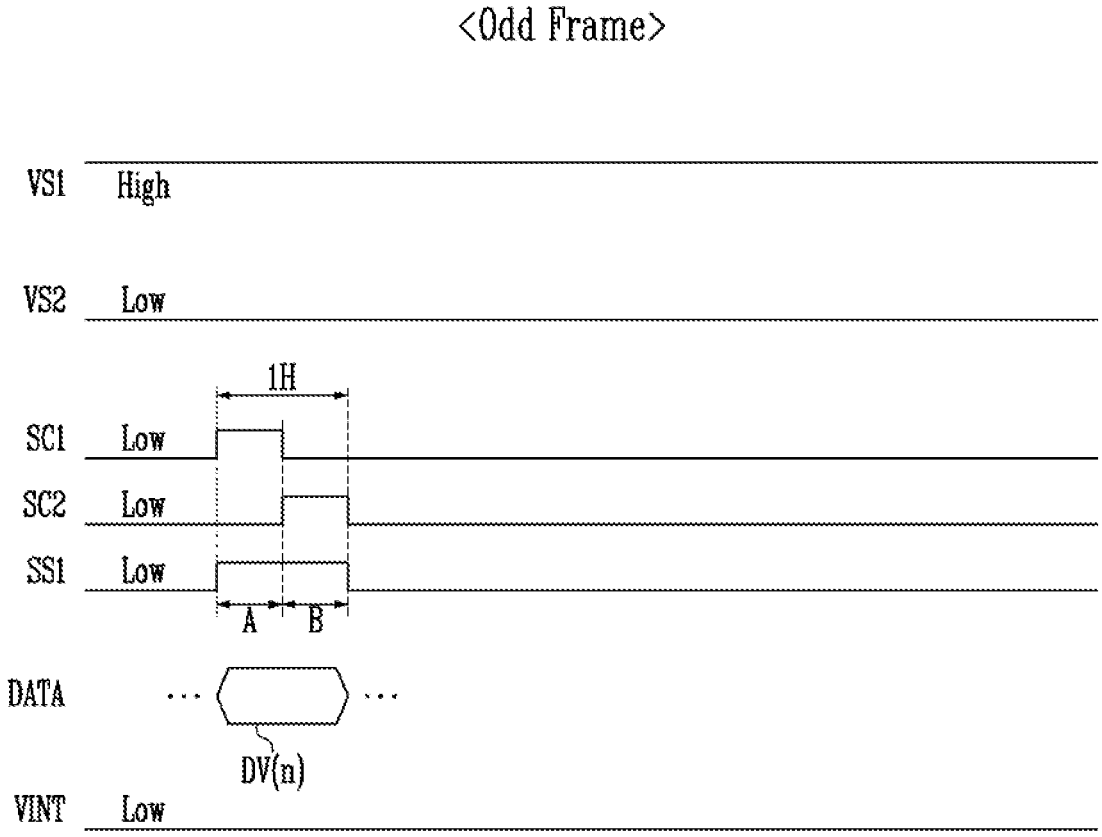
FIGS. 15A and 15B are timing diagrams for illustrating operation of a power supply shown in FIG. 8 and a driving method of a pixel shown in FIG. 14.
Figure 15B:
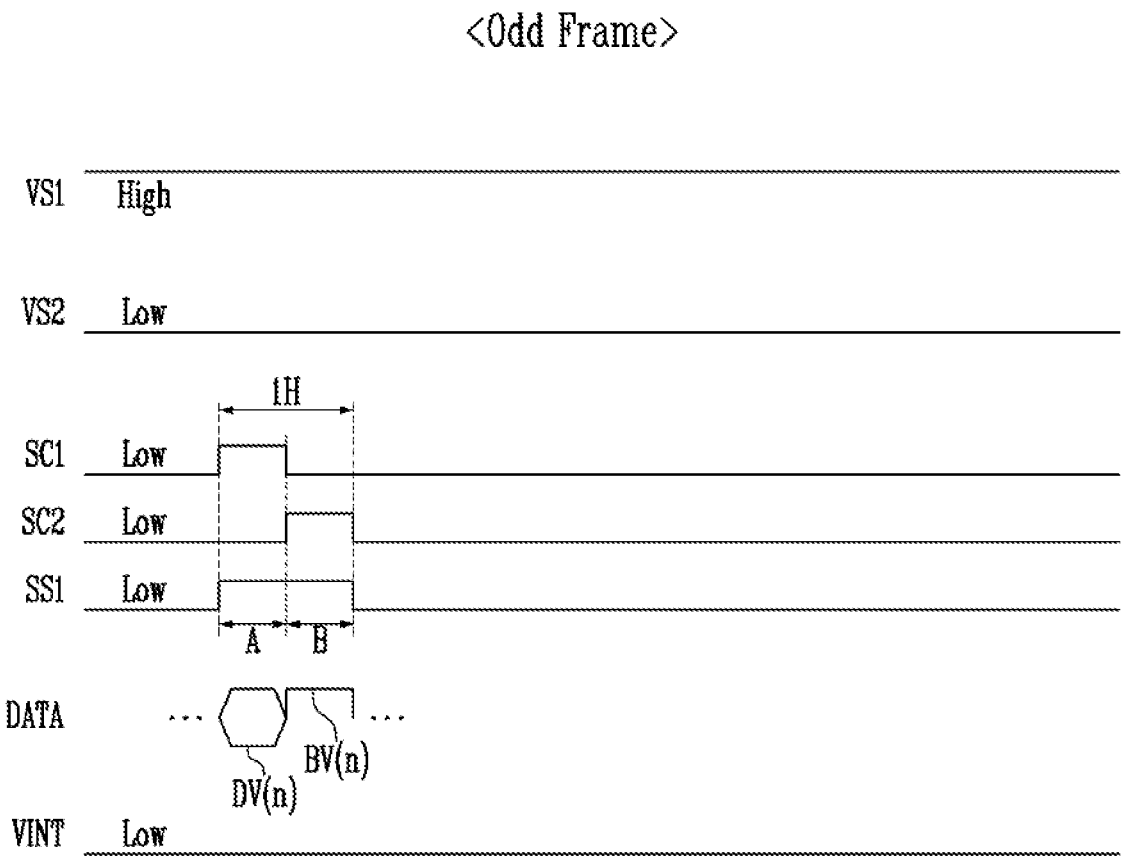

FIGS. 15A and 15B are timing diagrams for illustrating a power supply shown in FIG. 8 and a driving method of a pixel shown in FIG. 11. Specifically, FIGS. 15A and 15B are timing diagrams for illustrating a driving method of the power supply and the pixel during the first frame period, for example, the odd numbered frame period.

In FIGS. 15A and 15B, as described above, a voltage of the turn-on level of scan signals SC1, SC2, and SS1 will be defined as a voltage having a high level with respect to the pixel PXnm which is connected to the m-th data line DLm and the k-th sensing line ILk.

In addition, in describing the embodiment shown in FIGS. 15A and 15B, the description for the same thing as that shown in FIGS. 10A and 10B will be omitted, and the description will be focused on the difference.

Referring to FIG. 15A, during the odd numbered frame period, the power supply 170 supplies a first power voltage VS1 at the first level (e.g., a high level) to the first power line PL1, and a second power voltage VS2 at the second level (e.g., a low level) to the second power line PL2.

The first sub-scan driver 131 may supply the first scan signal SC1 at the turn-on level to the first scan line SL1*n* during the first period A in 1 horizontal period 1H. When the second transistor Tr2 is turned on by the first scan signal SC1, the n-th first data signal DV(n) is applied to the second node N2.

The second sub-scan driver 132 may supply the second scan signal SS1 at the turn-on level to the second scan line SL2*n* during 1 horizontal period 1H. When the third transistor Tr3 and the sixth transistor Tr6 are turned on by the second scan signal SS1, the initialization voltage VINT is applied to the first node N1 and the third node N3. Accordingly, the first electrode and the second electrode of each of the first light-emitting diode LD1 and the second light-emitting diode LD2 are initialized. In this case, the initialization voltage VINT may be, for example, a second level (e.g., a low level).

During the first period A, the initialization voltage is applied to the first electrode of the first storage capacitor Cst1, and the first data signal DV(n) is applied to the second electrode of the first storage capacitor Cst1. Accordingly, the difference voltage corresponding to the difference between the first data signal DV(n) and the initialization voltage is charged in the first storage capacitor Cst1.

The third sub-scan driver 133 may supply the third scan signal SC2 at the turn-on level to the third scan line SL3*n* during the second period B in 1 horizontal period 1H. When the fifth transistor Tr5 is turned on by the third scan signal SC2, the n-th first data signal DV(n) is applied to the fourth node N4 through the data line DLm.

When the second scan signal SS1 at the turn-on level is supplied to the second scan line SL2*n* during 1 horizontal period 1H, the third transistor Tr3 and the sixth transistor Tr6 are turned on, and the initialization voltage VINT is applied to the first node N1 and the third node N3.

During the second period B, the initialization voltage VINT is applied to the first electrode of the second storage capacitor Cst2, and the first data signal DV(n) is applied to the second electrode of the second storage capacitor Cst2. Accordingly, the difference voltage corresponding to the difference between the first data signal DV(n) and the initialization voltage VINT is charged in the second storage capacitor Cst2.

As the driving current Id flows as shown in FIG. 11A, the first light-emitting diode LD1 shown in FIG. 14 emits light after the second period B, and the second light-emitting diode LD2 shown in FIG. 14 does not emit light.

Referring to FIG. 15B, the embodiment shown in FIG. 15B is similar to the embodiment described above with reference to FIG. 15A, but is different from the embodiment described above with reference to FIG. 15A in that an n-th second data signal BV(n) instead of the n-th first data signal DV(n) is applied to the fourth node N4 during the second period B when the third scan signal SC2 is supplied. Here, the n-th second data signal BV(n) may be a voltage for turning on the driving transistor (e.g., the fourth transistor Tr4), and may mean a voltage such that equivalent resistance of the turned-on driving transistor (e.g., the fourth transistor Tr4) may have a minimum value.

Specifically, during the second period B in FIG. 15B, the difference voltage between the initialization voltage VINT and the second data signal BV(n) is charged in the second storage capacitor Cst2. Here, the second data signal BV(n) is set so that the fourth transistor Tr4 may be turned on, so the fourth transistor Tr4 may be stably turned on after the second period B. In an another embodiment, the second data signal BV(n) is set so that the fourth transistor Tr4 may be turned off, so the fourth transistor Tr4 may be stably turned off after the second period B.

In addition, as shown in FIG. 11B, at least one light-emitting diode (e.g., the first light-emitting diode LD1), aligned in the forward direction (or first direction) among the light-emitting diodes included in each of a plurality of pixels PX included in the display unit 160, may emit light.

Although the term "direction" as used herein may include the physical direction, in another embodiments it is the anode/cathode polarity direction or direction of current flow, such as where the first and second circuits are not physically disposed on substantially opposite sides of the first and second light-emitting diodes, and/or where the circuitry is arranged differently. That is, the term "direction" shall not be limited to the physical direction in which the light-emitting diodes are arranged in a physical circuit.

Figure 16A:
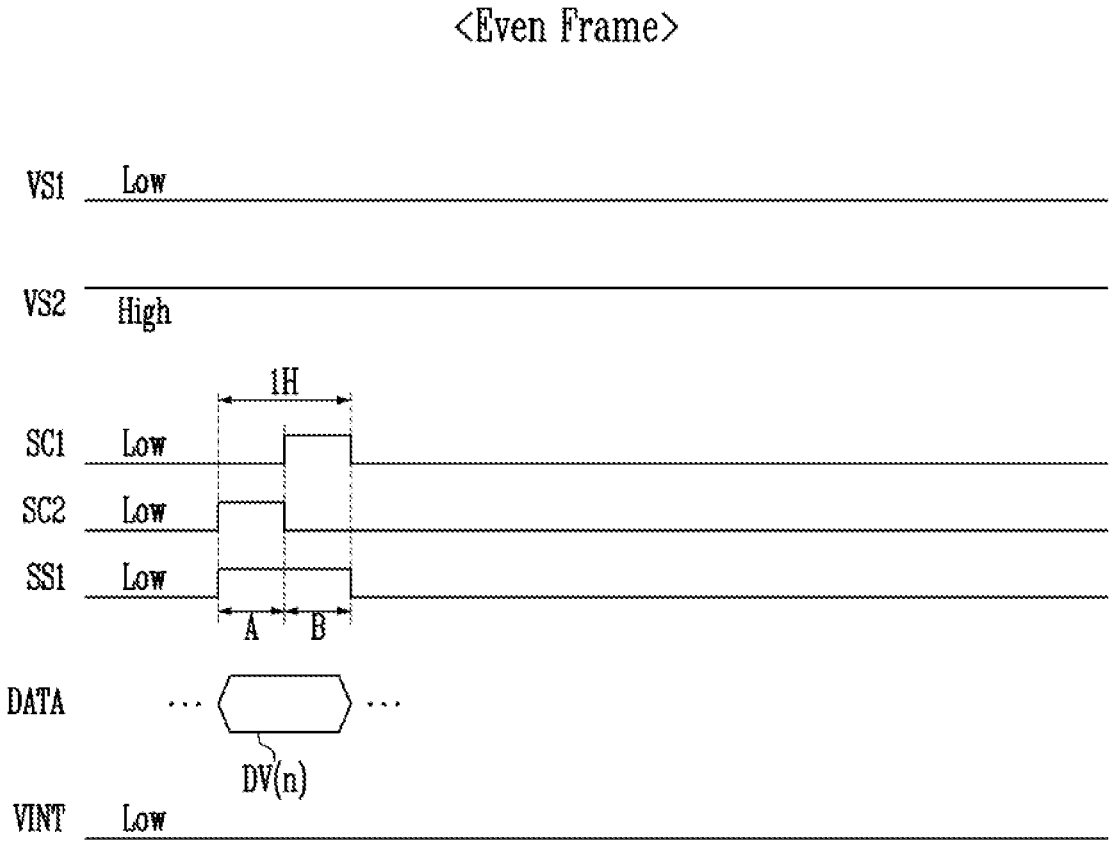
FIGS. 16A and 16B are timing diagrams for illustrating operation of a power supply shown in FIG. 8 and a driving method of a pixel shown in FIG. 14.
Figure 16B:
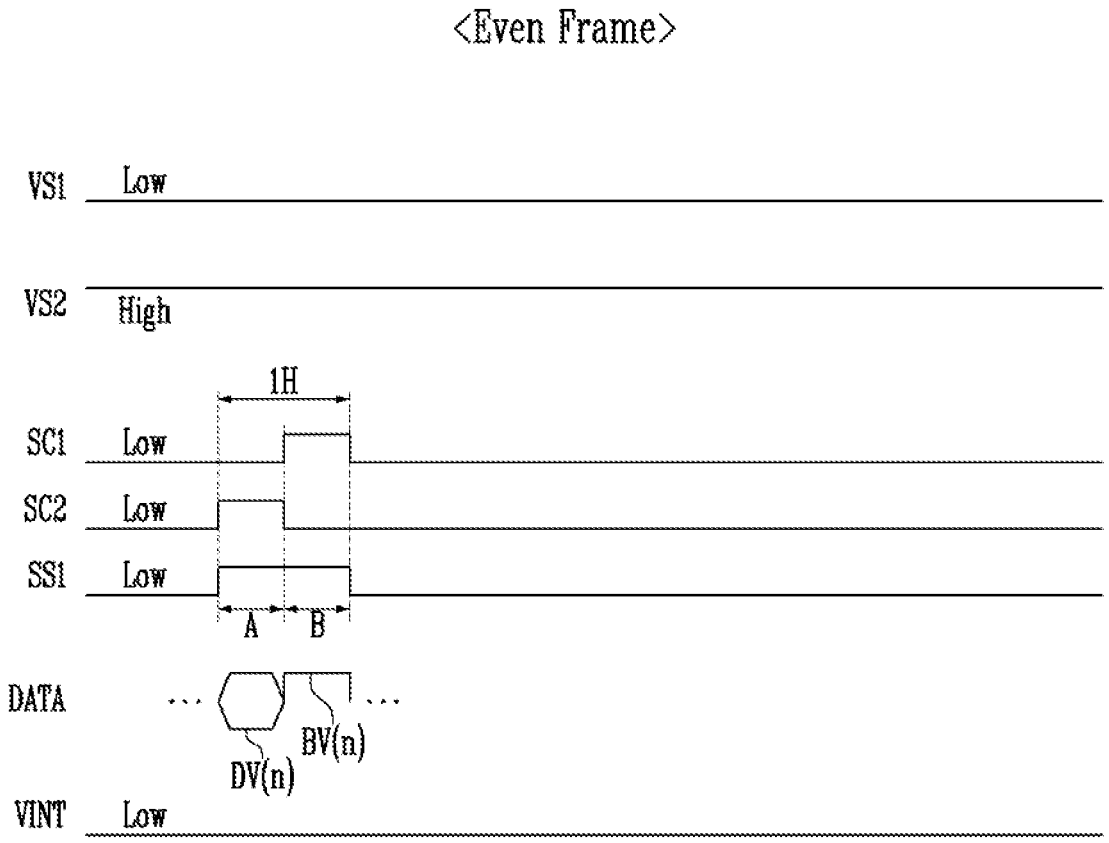

FIGS. 16A and 16B are timing diagrams for illustrating a power supply shown in FIG. 8 and a driving method of a pixel shown in FIG. 14. Specifically, FIGS. 16A and 16B are timing diagrams for illustrating a driving method of the power supply and the pixel during the second frame period, for example, the even numbered frame period.

In FIGS. 16A and 16B, for better understanding and ease of description, a pixel PXnm and a voltage at the turn-on level of the scan signals SC1, SC2, and SS1 are the same as described above with reference to FIGS. 15A and 15B.

In addition, in describing the embodiment shown in FIGS. 16A and 16B, the same thing as that shown in FIGS. 12A and 12B will be omitted, and the description will be focused on the difference.

Referring to FIG. 16A, during the even numbered frame period, the power supply 170 supplies a first power voltage VS1 at the second level (e.g., a low level) to the first power line PL1, and a second power voltage VS2 at the first level (e.g., a high level) to the second power line PL2.

The third sub-scan driver 133 may supply the third scan signal SC2 at the turn-on level to the third scan line SL3*n* during the first period A in 1 horizontal period 1H. When the fifth transistor Tr5 is turned on by the third scan signal SC2, the n-th first data signal DV(n) is applied to the fourth node N4 through the data line DLm.

The second sub-scan driver 132 may supply the second scan signal SS1 at the turn-on level to the second scan line SL2*n* during 1 horizontal period 1H. In this case, the third transistor Tr3 and the sixth transistor Tr6 are turned on by the second scan signal SS1. When the third transistor Tr3 and the sixth transistor Tr6 are turned on, the initialization voltage VINT is applied to the first node N1 and the third node N3, and thus the first electrode and the second electrode of each of the first light-emitting diode LD1 and the second light-emitting diode LD2 are initialized. In this case, the initialization voltage VINT may be, for example, a second level (e.g., a low level).

During the first period A, the initialization voltage VINT is applied to the first electrode of the second storage capacitor Cst2, and the first data signal DV(n) is applied to the second electrode of the second storage capacitor Cst2. Accordingly, the difference voltage corresponding to the difference between the first data signal DV(n) and the initialization voltage VINT is charged in the second storage capacitor Cst2.

The first sub-scan driver 131 may supply the first scan signal SC1 at the turn-on level to the first scan line SL1*n* during the second period B in 1 horizontal period 1H. When the second transistor Tr2 is turned on by the first scan signal SC1, the n-th first data signal DV(n) is applied to the second node N2.

When the second scan signal SS1 at the turn-on level is supplied to the second scan line SL2*n* during 1 horizontal period 1H, the third transistor Tr3 and the sixth transistor Tr6 are turned on, and then the initialization voltage VINT is applied to the first node N1 and the third node N3.

During the second period B, the initialization voltage is applied to the first electrode of the first storage capacitor Cst1, and the first data signal DV(n) is applied to the second electrode of the first storage capacitor Cst1. Accordingly, the difference voltage corresponding to the difference between the first data signal DV(n) and the initialization voltage is charged in the first storage capacitor Cst1.

As the driving current Id flows as shown in FIG. 13A, the first light-emitting diode LD1 shown in FIG. 14 does not emit light, and the second light-emitting diode LD2 shown in FIG. 14 emits light after the second period B.

Referring to FIG. 16B, the embodiment shown in FIG. 16B is similar to the embodiment described above with reference to FIG. 16A, but is different from the embodiment described above with reference to FIG. 16A in that an n-th second data signal BV(n) instead of the n-th first data signal DV(n) is applied to the second node N2 during the second period B when the first scan signal SC1 is supplied. Here, the second data signal BV(n) may be a voltage for turning on the driving transistor (e.g., the first transistor Tr1), and may mean a voltage such that equivalent resistance of the turned-on driving transistor (e.g., the first transistor Tr1) may have a minimum value.

Specifically, during the second period B in FIG. 16B, the difference voltage between the initialization voltage VINT and the second data signal BV(n) is charged in the first storage capacitor Cst1. Here, the second data signal BV(n) is set so that the first transistor Tr1 may be turned on, so the first transistor Tr1 may be stably turned on after the second period B. In addition, as shown in FIG. 13B, at least one light-emitting diode (e.g., the second light-emitting diode LD2), aligned in the reverse direction (or second direction) among the light-emitting diodes included in each of a plurality of pixels PX included in the display unit 160, may emit light.

Meanwhile, when the number of light-emitting diodes (e.g., the first light-emitting diodes LD1) aligned in the forward direction (or first direction) among the light-emitting diodes LD included in the pixel is the same as the number of the light-emitting diodes (e.g., the second light-emitting diodes LD2) aligned in the reverse direction (or second direction) among the light-emitting diodes LD included in the pixel, a difference in luminance between the odd numbered frame and the even numbered frame is very small.

However, when the number of light-emitting diodes (e.g., the first light-emitting diodes LD1) aligned in the forward direction (or first direction) among the light-emitting diodes LD included in the pixel is different from the number of the light-emitting diodes (e.g., the second light-emitting diodes LD2) aligned in the reverse direction (or second direction) among the light-emitting diodes LD included in the pixel, the light-emitting diode LD emitting light in the odd numbered frame is different from the light-emitting diode LD emitting light in the even numbered frame. Therefore, a difference in luminance may occur between the odd numbered frame and the even numbered frame to generate a flicker.

Thus, a pixel structure in which light-emitting diodes LD included in one pixel may alternately emit light during one frame is provided.

Hereinafter, such a pixel will be described in detail.

Figure 17:
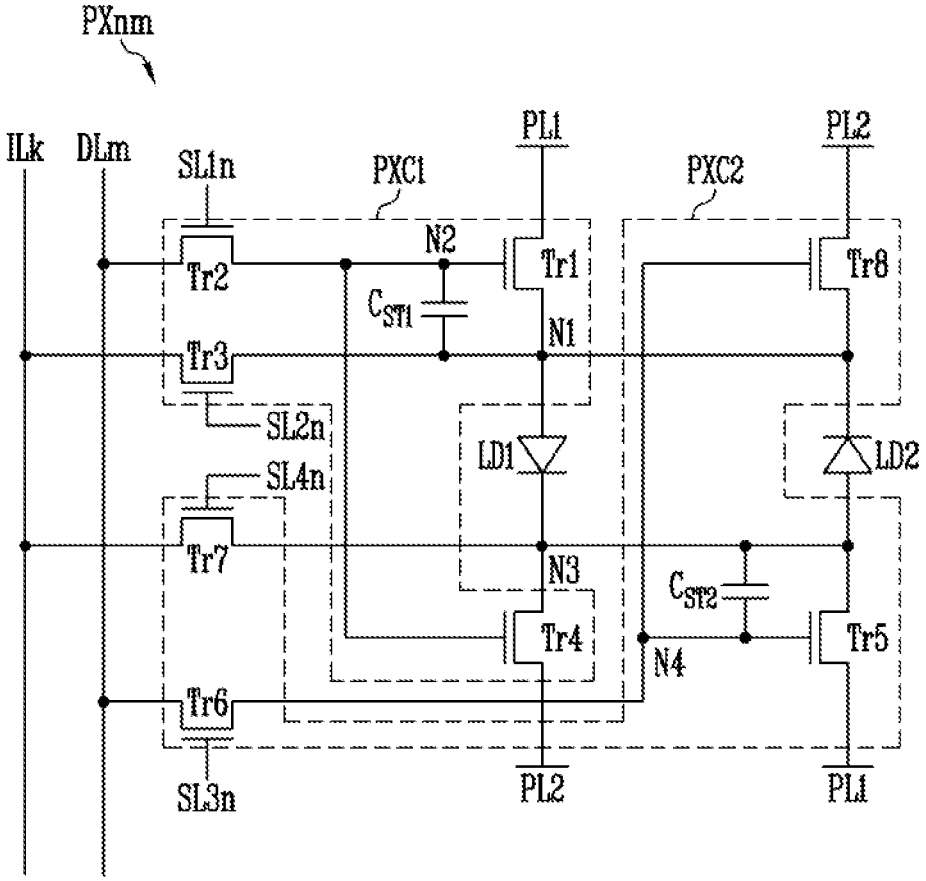
FIG. 17 is a circuit diagram of a pixel according to an embodiment of the present invention.

FIG. 17 is a circuit diagram of a pixel according to an embodiment of the present invention.

In FIG. 17, for better understanding and ease of description, an embodiment of the present invention will be described with respect to a pixel PXnm (or first pixel) disposed on an n-th horizontal line and connected to a m-th data line DLm and a k-th sensing line ILk.

Referring to FIG. 17, the pixel PXnm may include a first pixel circuit PXC1 and a second pixel circuit PXC2, and light-emitting diodes LD1 and LD2.

The first pixel circuit PXC1 may drive the first light-emitting diode LD1. The first pixel circuit PXC1 may be connected to a first power line PL1, a second power line PL2, a first scan line SL1*n*, a second scan line SL2*n*, a data line DLm, a sensing line ILk, a first light-emitting diode LD1, and a second light-emitting diode LD2.

The first pixel circuit PXC1 may include a first transistor Tr1, a second transistor Tr2, a third transistor Tr3, a fourth transistor Tr4, and a first storage capacitor Cst1.

A first electrode of the first transistor Tr1 may be connected to the first power line PL1, a second electrode of the first transistor Tr1 may be connected to the first node N1, and a gate electrode of the first transistor Tr1 may be connected to the second node N2.

The second transistor Tr2 may be connected between the data line DLm and the second node N2. That is, a first electrode of the second transistor Tr2 may be connected to the data line DLm, a second electrode of the second transistor Tr2 may be connected to the second node N2, and a gate electrode of the second transistor Tr2 may be connected to the first scan line SL1*n*.

The third transistor Tr3 may be connected between the second electrode (e.g., the first node N1) of the first transistor Tr1 and the sensing line ILk. That is, a first electrode of the third transistor Tr3 may be connected to the first node N1, a second electrode of the third transistor Tr3 may be connected to the sensing line ILk, and a gate electrode of the third transistor Tr3 may be connected to the second scan line SL2*n*. The third transistor Tr3 is turned on when a second scan signal SS1 having a pulse at a turn-on level is supplied to the second scan line SL2*n* to electrically connect the sensing line ILk and the first node N1. Meanwhile, when the third transistor Tr3 is turned on, the initialization voltage supplied to the sensing line ILk may be applied to the first node N1. When the initialization voltage is applied to the first node N1, the first electrode (e.g., the anode) of the first light-emitting diode LD1 and the second electrode (e.g., the cathode) of the second light-emitting diode LD2 may be initialized.

The fourth transistor Tr4 may control the driving current based on the data signal. A first electrode of the fourth transistor Tr4 may be connected to the second power line PL2, a second electrode of the fourth transistor Tr4 may be connected to the third node N3, and a gate electrode of the fourth transistor Tr4 may be connected to the second node N2.

Since the first storage capacitor Cst1 is the same as that shown in FIGS. 9 and 14, the description thereof is omitted.

The second pixel circuit PXC2 may drive the second light-emitting diode LD2. The second pixel circuit PXC2 may be connected to the first power line PL1, the second power line PL2, the third scan line SL3*n*, the fourth scan line SL4*n*, the data line DLm, the sensing line ILk, the first light-emitting diode LD1, and the second emitting diode LD2.

The second pixel circuit PXC2 may include a fifth transistor Tr5, a sixth transistor Tr6, a seventh transistor Tr7, an eighth transistor Tr8, and a second storage capacitor Cst2.

The fifth transistor Tr5 may control the driving current based on the data signal. A first electrode of the fifth transistor Tr5 may be connected to the first power line PL1, a second electrode of the fifth transistor Tr5 may be connected to the third node N3, and a gate electrode of the fifth transistor Tr5 may be connected to the fourth node N4.

The sixth transistor Tr6 may be connected between the data line DLm and the fourth node N4. That is, a first electrode of the sixth transistor Tr6 may be connected to the data line DLm, a second electrode of the sixth transistor Tr6 may be connected to the fourth node N4, and a gate electrode of the sixth transistor Tr6 may be connected to the third scan line SL3*n*.

The seventh transistor Tr7 may be connected between the second electrode (e.g., the third node N3) of the fourth transistor Tr4 and the sensing line ILk. That is, a first electrode of the seventh transistor Tr7 may be connected to the third node N3, a second electrode of the seventh transistor Tr7 may be connected to the sensing line ILk, and a gate electrode of the seventh transistor Tr7 may be connected to the fourth scan line SL4*n*. The seventh transistor Tr7 is turned on when the fourth scan signal SS2 having a pulse at a turn-on level is supplied to the fourth scan line SL4*n* to electrically connect the sensing line ILk and the third node N3. On the other hand, when the seventh transistor Tr7 is turned on, the initialization voltage supplied to the sensing line ILk may be applied to the third node N3. When the initialization voltage is applied to the third node N3, the second electrode (e.g., the cathode) of the first light-emitting diode LD1 and the first electrode (e.g., the anode) of the second light-emitting diode LD2 may be initialized.

In an embodiment, the initialization voltage may be a voltage having a low level.

The eighth transistor Tr8 may control the driving current based on the data signal. A first electrode of the eighth transistor Tr8 may be connected to the second power line PL2, a second electrode of the eighth transistor Tr8 may be connected to the first node N1, and a gate electrode of the eighth transistor Tr8 may be connected to the fourth node N4.

Since the second storage capacitor Cst2 is the same as that shown in FIGS. 9 and 14, the description thereof is omitted.

In an embodiment, transistors Tr1 to Tr8 may be composed of N-type transistors, may be composed of P-type transistors, or may be composed of a combination of N-type transistors and P-type transistors. For example, the transistors Tr1 to Tr8 may be N-type transistors as shown in FIG. 17. However, the embodiment is not limited thereto.

Since the first light-emitting diode LD1 and the second light-emitting diode LD2 are the same as that shown in FIGS. 9 and 14, the description thereof is omitted.

In an embodiment, the first power voltage supplied to the first power line PL1 may be higher than the second power voltage supplied to the second power line PL2.

When the initialization voltage is supplied to the first and second electrodes of the light-emitting diodes LD1 and LD2, a parasitic capacitor of each of the light-emitting diodes LD1 and LD2 may be discharged. As a residual voltage charged in the parasitic capacitor is discharged (removed), unintentional fine light emission may be prevented. Therefore, black display ability of pixel PXnm may be improved.

Hereinafter, a driving method of the power supply and the pixel shown in FIG. 17 will be described in detail.

Figure 18:
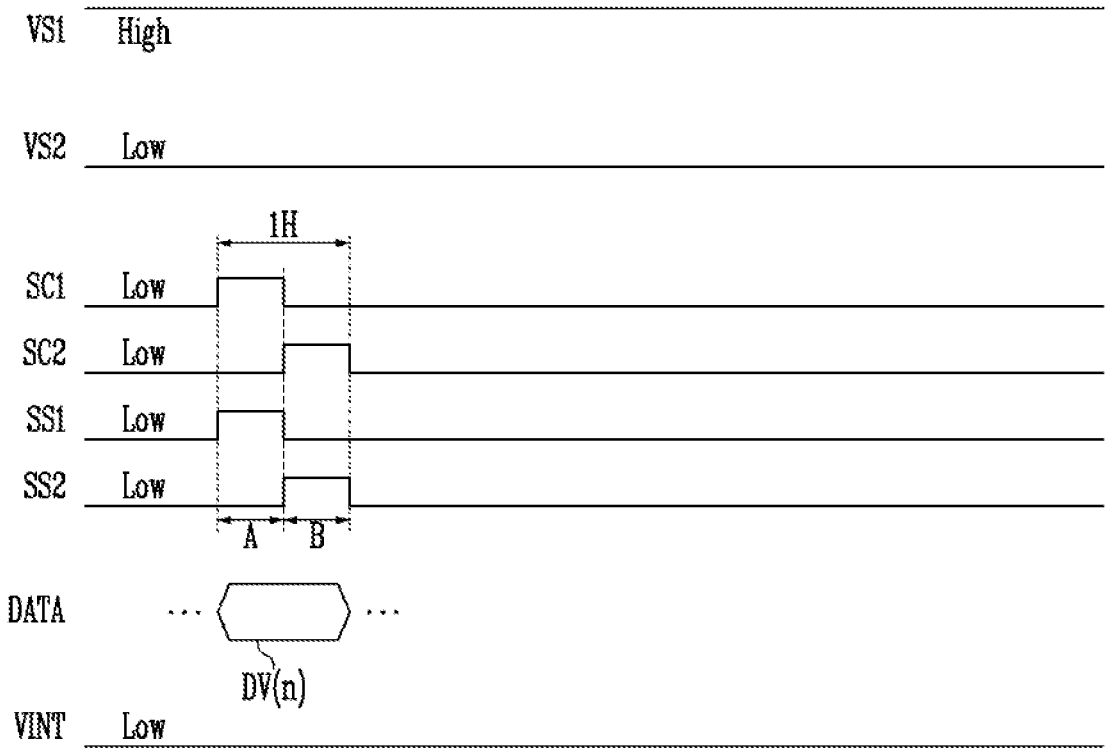
FIG. 18 is a timing diagram for illustrating operation of a power supply shown in FIG. 8 and a driving method of a pixel shown in FIG. 17.
Figure 19:
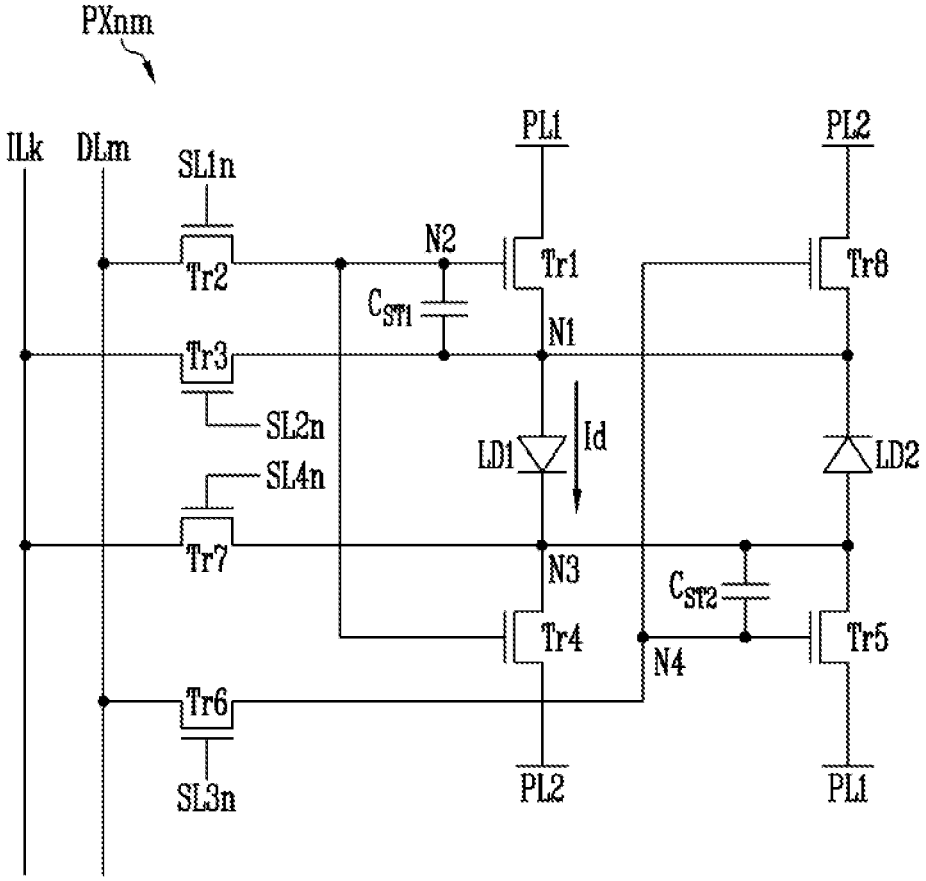
FIGS. 19 and 20 are drawings showing an embodiment in which a pixel shown in FIG. 17 emits light according to a driving method shown in FIG. 18.
Figure 20:
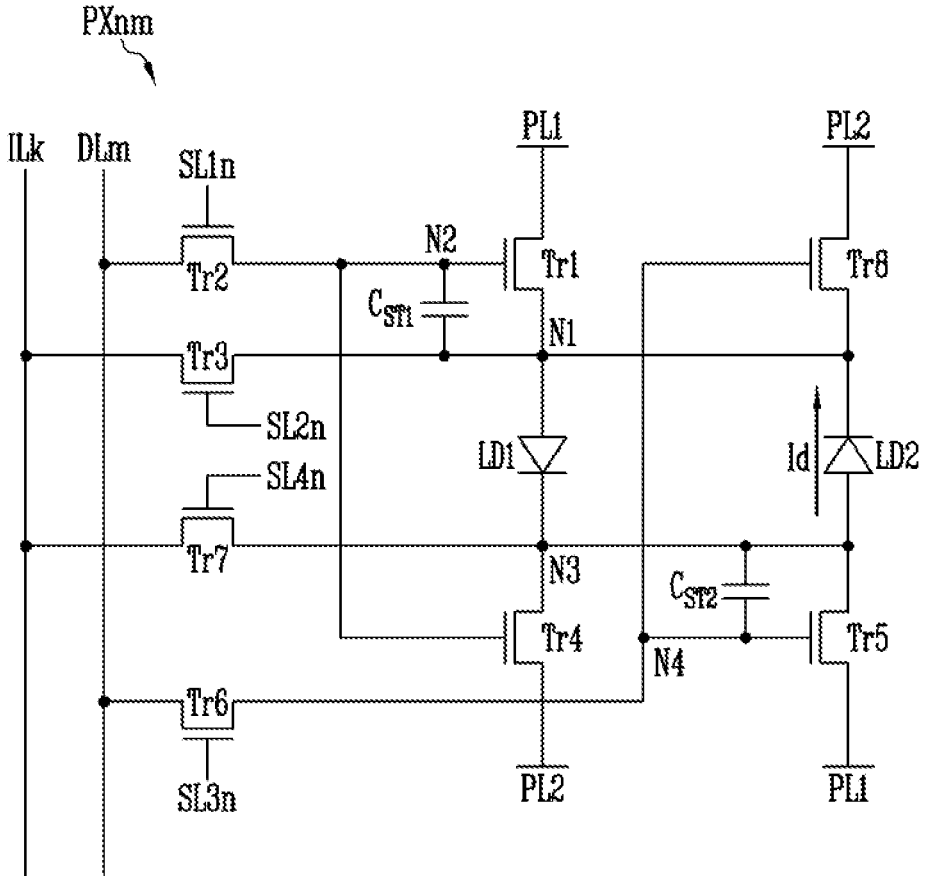
Figure 21A:
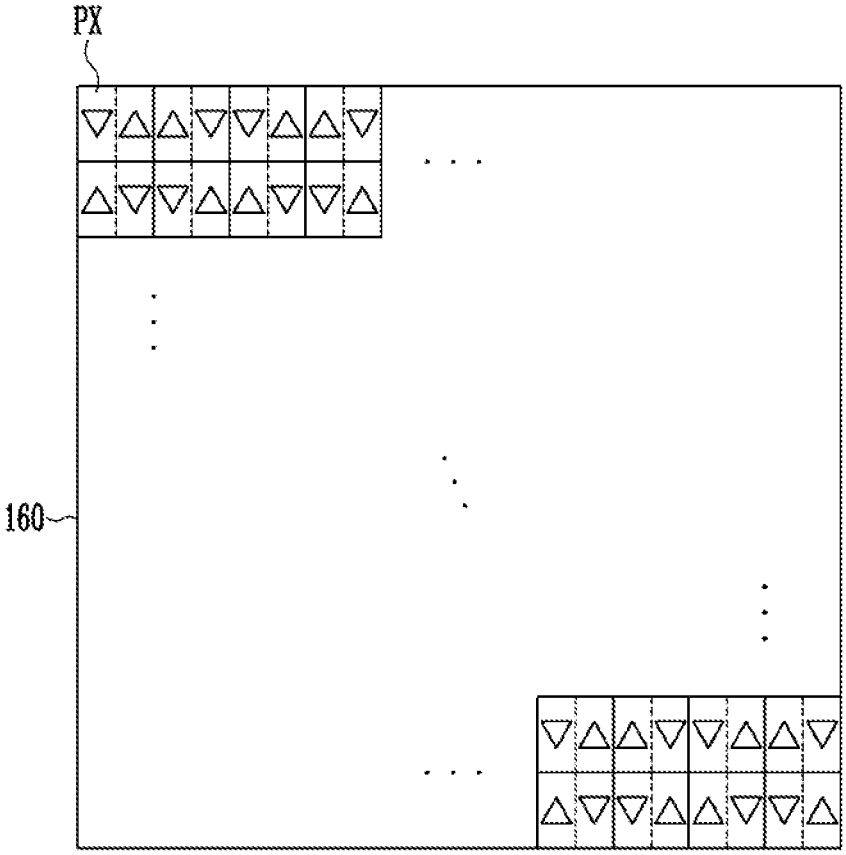
FIGS. 21A and 21B are schematic diagrams showing an embodiment in which a pixel shown in FIG. 17 emits light according a driving method shown in FIG. 18.
Figure 21B:
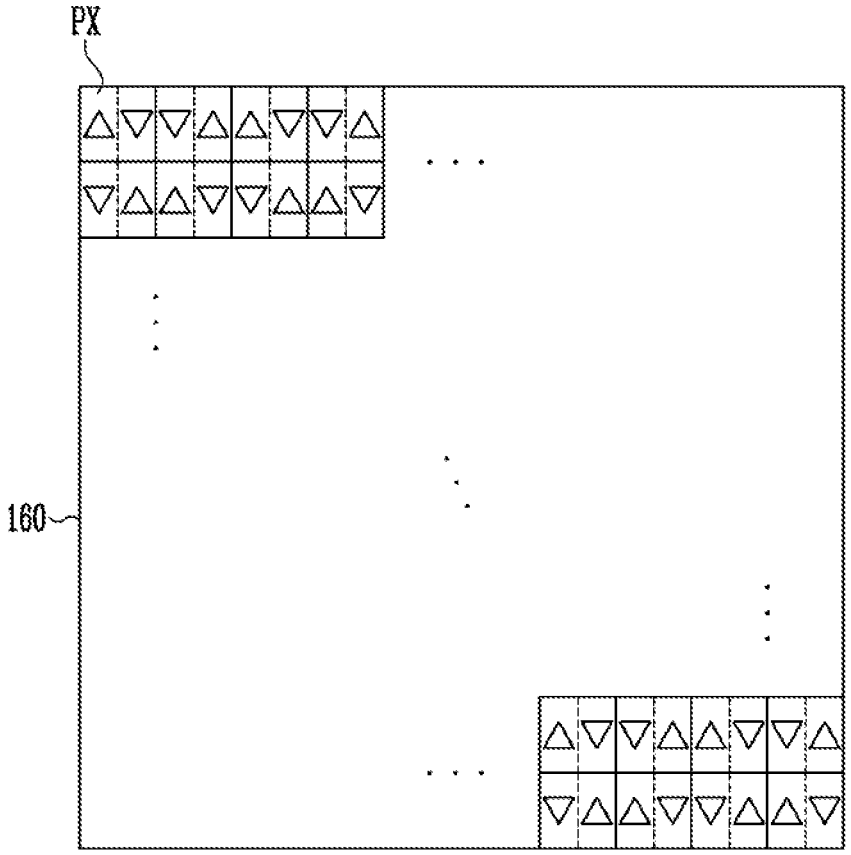

FIG. 18 is a timing diagram for illustrating a power supply shown in FIG. 8 and a driving method of a pixel shown in FIG. 17, FIGS. 19 and 20 are drawings showing an embodiment in which a pixel shown in FIG. 17 emits light according a driving method shown in FIG. 18, and FIGS. 21A and 21B are drawings showing an embodiment in which a pixel shown in FIG. 17 emits light according a driving method shown in FIG. 18.

In FIGS. 18 to 20, for better understanding and ease of description, a driving method of a pixel PXnm will be described with respect to the pixel PXnm (or first pixel) which is disposed on the n-th horizontal line and is connected to the m-th data line DLm and the k-th sensing line ILk, and a voltage at the turn-on level of the scan signals SC1, SC2, SS1, and SS2 is defined as a voltage having a high level.

Referring to FIG. 18, the power supply 170 supplies a first power voltage VS1 at a first level to the first power line PL1, and a second power voltage VS2 at a second level to the second power line PL2.

For example, the first power voltage VS1 at a high level is supplied to the first power line PL1, and the second power voltage VS2 at a low level is supplied to the second power line PL2.

The first sub-scan driver 131 may supply the first scan signal SC1 at the turn-on level to the first scan line SL1*n* during the first period A in 1 horizontal period 1H.

When the first scan signal SC1 is supplied, the second transistor Tr2 is turned on by the first scan signal SC1. When the second transistor Tr2 is turned on, the n-th first data signal DV(n) is applied to the second node N2 through the data line DLm. When the first data signal DV(n) is applied to the second node N2, the first transistor Tr1 and the fourth transistor Tr4 are turned on.

The second sub-scan driver 132 may supply the second scan signal SS1 at the turn-on level to the second scan line SL2*n* during the first period A in 1 horizontal period 1H.

In an embodiment, the second scan signal SS1 may be supplied in synchronization at the time when the first scan signal SC1 at the turn-on level is supplied.

When the second scan signal SS1 is supplied, the third transistor Tr3 is turned on by the second scan signal SS1. When the third transistor Tr3 is turned on, the initialization voltage VINT is applied to the first node N1 through the sensing line ILk. When the initialization voltage VINT is applied to the first node N1, the first electrode of the first light-emitting diode LD1 and the second electrode of the second light-emitting diode LD2 are initialized. At this time, the initialization voltage VINT may be, for example, a second level. In an embodiment, the initialization voltage VINT may be a low level.

During the first period A, the initialization voltage is applied to the first electrode of the first storage capacitor Cst1, and the first data signal DV(n) is applied to the second electrode of the first storage capacitor Cst1. Accordingly, the difference voltage corresponding to the difference between the first data signal DV(n) and the initialization voltage is charged in the first storage capacitor Cst1.

The third sub-scan driver 133 may supply the third scan signal SC2 at the turn-on level to the third scan line SL3*n* during the second period B in 1 horizontal period 1H.

When the third scan signal SC2 is supplied, the sixth transistor Tr6 is turned on by the third scan signal SC2. When the sixth transistor Tr6 is turned on, the n-th first data signal DV(n) is applied to the fourth node N4 through the data line DLm. When the first data signal DV(n) is applied to the fourth node N4, the fifth transistor Tr5 and the eighth transistor Tr8 are turned on.

The fourth sub-scan driver 134 may supply the fourth scan signal SS2 at the turn-on level to the fourth scan line SL4*n* during the second period B in 1 horizontal period 1H.

In an embodiment, the fourth scan signal SS2 may be supplied in synchronization at the time when the third scan signal SC2 at the turn-on level is supplied.

When the fourth scan signal SS2 is supplied, the seventh transistor Tr7 is turned on by the fourth scan signal SS2. When the seventh transistor Tr7 is turned on, the initialization voltage VINT is applied to the third node N3 through the sensing line ILk. When the initialization voltage VINT is applied to the third node N3, the second electrode of the first light-emitting diode LD1 and the first electrode of the second light-emitting diode LD2 are initialized. At this time, the initialization voltage VINT may be, for example, a second level. In an embodiment, the initialization voltage VINT may be a low level.

During the second period B, the initialization voltage VINT is applied to the first electrode of the second storage capacitor Cst2, and the first data signal DV(n) is applied to the second electrode of the second storage capacitor Cst2. Accordingly, the difference voltage corresponding to the difference between the first data signal DV(n) and the initialization voltage VINT is charged in the second storage capacitor Cst2.

In an embodiment, 1 horizontal period 1H may mean a period from the first period A to the second period B.

In an embodiment, the first period A and the second period B may not overlap each other. In addition, a time interval of the first period A and a time interval of the second period B may be the same as shown in FIG. 18, but is not limited thereto.

Referring to FIGS. 19 and 20, when the first data signal stored in the first storage capacitor Cst1 during the first period A is applied to the second node N2, the first transistor Tr1 and the fourth transistor Tr4 are turned on. And then, during the second period B, when the first data signal stored in the second storage capacitor Cst2 is applied to the fourth node N4, the fifth transistor Tr5 and eighth transistor Tr8 are turned on.

When the first transistor Tr1 and the fourth transistor Tr4 are turned on, the driving current Id flows in a path formed by the first power line PL1, the first transistor Tr1, the first light-emitting diode LD1, the fourth transistor Tr4, and the second power line PL2. And then, when the fifth transistor Tr5 and the eighth transistor Tr8 are turned on, the driving current Id flows in a path formed by the first power line PL1, the fifth transistor Tr5, the second light-emitting diode LD2, the eighth transistor Tr8, and the second power line PL2.

Therefore, after the second period B, both the first light-emitting diode LD1 and the second light-emitting diode LD2 may emit light.

Referring to FIGS. 21A and 21B, light-emitting diodes included in each of a plurality of pixels PX included in the display unit 160 may emit light during one frame period.

Therefore, when comparing FIGS. 21A and 21B and FIGS. 11B and 13B, since all the light-emitting diodes included in the pixel PXnm shown in FIG. 17 emit light during one frame period, an embodiment shown in FIG. 17 may minimize differences in luminance between frames and further improve a flicker due to the differences in luminance between frames compared to the embodiment shown in FIG. 9.

Meanwhile, in FIG. 18, the first scan signal SC1 and the second scan signal SS1 at the turn-on level are shown to be supplied during the first period A, and the third scan signal SC2 and the fourth scan signal SS2 at the turn-on level are shown to be supplied during the second period B after the first scan signal SC1 and the second scan signal SS1 are supplied, but is not limited thereto. The third scan signal SC2 and the fourth scan signal SS2 at the turn-on level may be supplied during the first period A, and the first scan signal SC1 and the second scan signal SS1 at the turn-on level may be supplied during the second period B.

Figure 22:
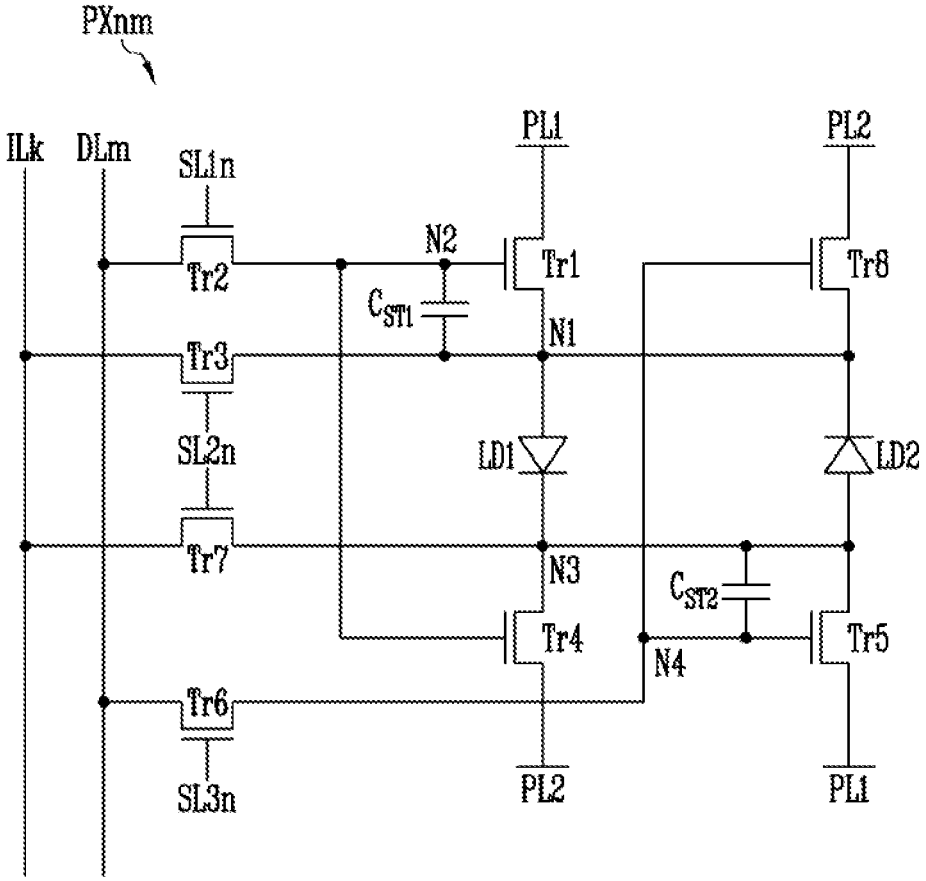
FIG. 22 is a circuit diagram for a modified embodiment of a pixel shown in FIG. 17.

FIG. 22 is a modified embodiment of a pixel shown in FIG. 17.

In describing the pixel PXnm shown in FIG. 22, the description will be omitted for the same configuration as that shown in FIG. 17, and the description will be focused on the difference.

Referring to FIGS. 17 and 22, as described above with reference to FIG. 1, since the second sub-scan driver 132 and the fourth sub-scan driver 134 may be composed of a single sub-scan driver, the second scan line SL2*n* and the fourth scan line SL4*n* shown in FIG. 17 may be integrated into one scan line, for example, the second scan line SL2*n* shown in FIG. 22. In addition, the second scan signal SS1 and the fourth scan signal SS2 may be the same.

According to the above, it is possible to reduce the manufacturing cost by not adding a scan line, and to further reduce power consumption by not adding a scan signal.

Hereinafter, a driving method of the pixel shown in FIG. 23 will be described with respect to the second scan line SL2*n* and the second scan signal SS1.

Figure 23:
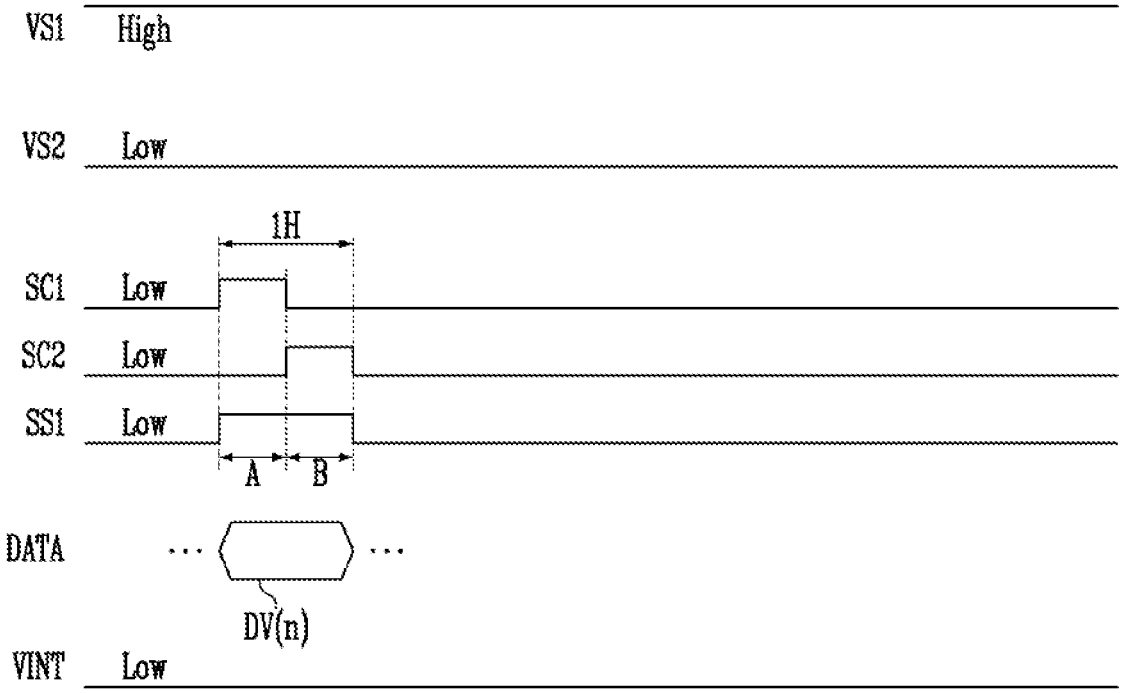
FIG. 23 is a timing diagram for illustrating operation of a power supply shown in FIG. 8 and a driving method of a pixel shown in FIG. 22.

FIG. 23 is a timing diagram for illustrating a power supply shown in FIG. 8 and a driving method of a pixel shown in FIG. 22.

In FIG. 23, as described above with reference to FIGS. 17 to 20, a voltage of the turn-on level of scan signals SC1, SC2, and SS1 will be defined as a voltage having a high level with respect to the pixel PXnm which is connected to the m-th data line DLm and the k-th sensing line ILk, without limitation thereto.

In addition, in describing the embodiment shown in FIG. 23, the same thing as that shown in FIG. 18 will be omitted, and the description will be focused on the difference.

Referring to FIG. 23, the power supply 170 supplies a first power voltage VS1 at a first level (e.g., a high level) to the first power line PL1, and a second power voltage VS2 at a second level (e.g., a low level) to the second power line PL2.

The first sub-scan driver 131 may supply the first scan signal SC1 at the turn-on level to the first scan line SL1*n* during the first period A in 1 horizontal period 1H. When the second transistor Tr2 is turned on by the first scan signal SC1, the n-th first data signal DV(n) is applied to the second node N2. And then, when the n-th first data signal DV(n) is applied to the second node N2 during the first period A, the first transistor Tr1 and the fourth transistor Tr4 are turned on.

The second sub-scan driver 132 may supply the second scan signal SS1 at the turn-on level to the second scan line SL2*n* during 1 horizontal period 1H. In this case, the third transistor Tr3 and the seventh transistor Tr7 are turned on by the second scan signal SS1. When the third transistor Tr3 and the seventh transistor Tr7 are turned on, the initialization voltage VINT is applied to the first node N1 and the third node N3, so that the first electrode and the second electrode of each of the first light-emitting diode LD1 and the second light-emitting diode LD2 are initialized. In this case, the initialization voltage VINT may be, for example, a second level (e.g., a low level).

During the first period A, the initialization voltage is applied to the first electrode of the first storage capacitor Cst1, and the first data signal DV(n) is applied to the second electrode of the first storage capacitor Cst1. Accordingly, the difference voltage corresponding to the difference between the first data signal DV(n) and the initialization voltage is charged in the first storage capacitor Cst1.

The third sub-scan driver 133 may supply the third scan signal SC2 at the turn-on level to the third scan line SL3*n* during the second period B in 1 horizontal period 1H. When the sixth transistor Tr6 is turned on by the third scan signal SC2, the n-th first data signal DV(n) is applied to the fourth node N4 through the data line DLm. And then, when the n-th first data signal DV(n) is applied to the fourth node N4 during the second period B, the fifth transistor Tr5 and the eighth transistor Tr8 are turned on.

When the second scan signal SS1 at the turn-on level is supplied to the second scan line SL2*n* during 1 horizontal period 1H, the third transistor Tr3 and the seventh transistor Tr7 are turned on, and then the initialization voltage VINT is applied to the first node N1 and the third node N3.

During the second period B, the initialization voltage VINT is applied to the first electrode of the second storage capacitor Cst2, and the first data signal DV(n) is applied to the second electrode of the second storage capacitor Cst2. Accordingly, the difference voltage corresponding to the difference between the first data signal DV(n) and the initialization voltage VINT is charged in the second storage capacitor Cst2.

As shown in FIG. 19, when the first transistor Tr1 and the fourth transistor Tr4 are turned on, the driving current Id flows through the first light-emitting diode LD1. As shown in FIG. 20, when the fifth transistor Tr5 and the eighth transistor Tr8 are turned on, the driving current Id flows through the second light-emitting diode LD2. Therefore, after the second period B, both the first light-emitting diode LD1 and the second light-emitting diode LD2 may emit light.

An alignment ratio between the number of light-emitting diodes (e.g., the first light-emitting diode LD1) aligned in the forward direction (or first direction) among the light-emitting diodes LD included in the pixel and the number of light-emitting diodes (e.g., the second light-emitting diode LD2) aligned in the reverse direction (or second direction) among the light-emitting diodes LD included in the pixel, may be different for each of a plurality of pixels.

In this case, the pixels PXnm disposed on the selected current horizontal line (or current pixel row) are driven simultaneously depending on the desired grayscale value, so that the difference in luminance may occur between the pixels PXnm disposed on a current horizontal line (or current pixel row) when the above-described alignment ratio is different for each pixel PXnm disposed on the current horizontal line (or current pixel row).

Thus, in the case of the first pixel and the second pixel disposed on the current horizontal line (or current pixel row), a structure in which a connection structure between the first scan line SL1 and second scan line SL2 and the second transistor Tr2 and sixth transistor Tr6 of the first pixel is opposite to a connection structure between the first scan line SL1 and second scan line SL2 and the second transistor Tr2 and sixth transistor Tr6 of the second pixel, will be described in detail.

Figure 24:
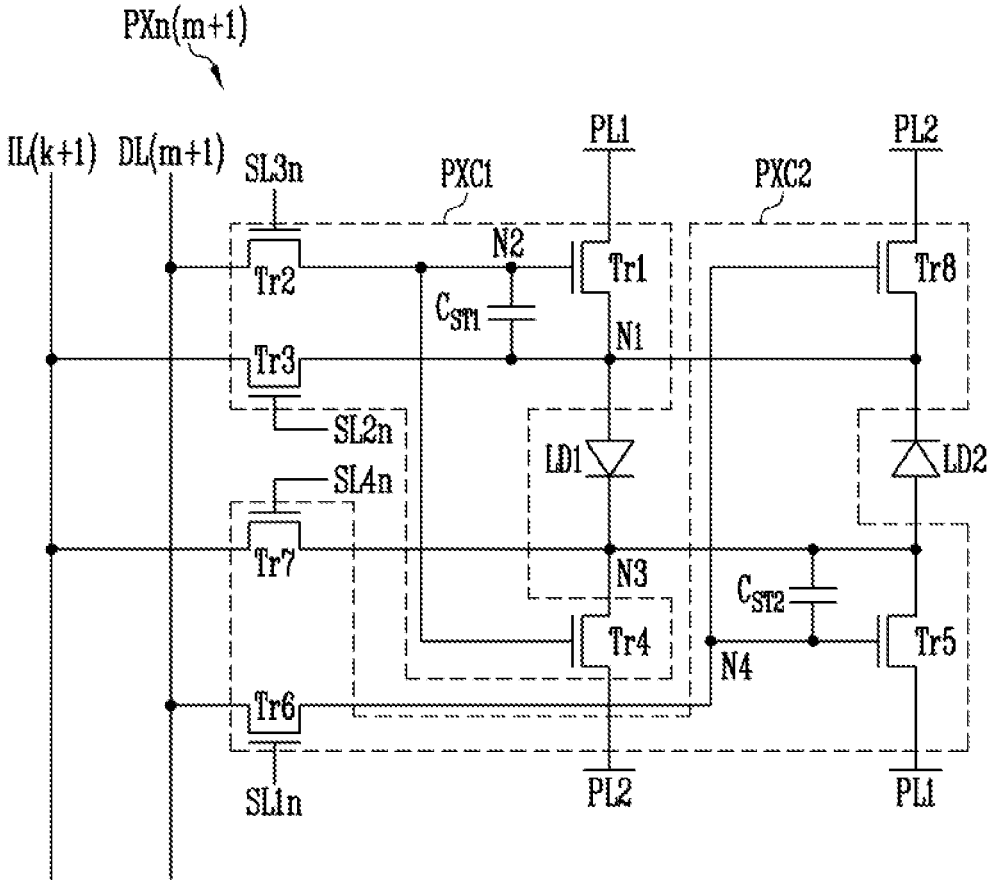
FIG. 24 is a circuit diagram of a pixel disposed on the same pixel row as a pixel shown in FIG. 17.

FIG. 24 is a circuit diagram of a pixel disposed on the same pixel row as a pixel shown in FIG. 17.

In FIG. 24, for better understanding and ease of description, an embodiment of the present invention will be described with respect to a pixel PXn(m+1) which is disposed on the same n-th horizontal line as the pixel PXnm shown in FIG. 17 and which is connected to an m+1-th data line DL (m+1) and an k+1-th sensing line IL (k+1).

In addition, in describing the pixel shown in FIG. 24, for better understanding and ease of description, the pixel PXnm shown in FIG. 17 is defined as the first pixel, and the pixel PXn(m+1) shown in FIG. 24 is defined as the second pixel. In the pixel PXn(m+1) shown in FIG. 24, the description will be omitted for the same configuration as that shown in FIG. 17, and the description will be focused on the difference.

Referring to FIG. 24, the pixel PXn(m+1) may include a first pixel circuit PXC1, a second pixel circuit PXC2, and light-emitting diodes LD1 and LD2.

The first pixel circuit PXC1 may include a first transistor Tr1, a second transistor Tr2, a third transistor Tr3, a fourth transistor Tr4, and a first storage capacitor Cst1, and the second pixel circuit PXC2 may include a fifth transistor Tr5, a seventh transistor Tr7, a sixth transistor Tr6, an eighth transistor Tr8, and a second storage capacitor Cst2.

Since the first transistor Tr1, the third transistor Tr3 to fifth transistor Tr5, the seventh transistor Tr7, the eighth transistor Tr8, and the storage capacitors Cst1 and Cst2 are the same as that shown in FIG. 17, the description thereof will be omitted.

A first electrode of the second transistor Tr2 may be connected to the data line DLm, a second electrode of the second transistor Tr2 may be connected to the second node N2, and a gate electrode of the second transistor Tr2 may be connected to the third scan line SL3*n*.

A first electrode of the sixth transistor Tr6 may be connected to the data line DLm, a second electrode of the sixth transistor Tr6 may be connected to the fourth node N4, and a gate electrode of the sixth transistor Tr6 may be connected to the first scan line SL1*n*.

Since the light-emitting diodes LD1 and LD2 are the same as that shown in FIG. 17, the description thereof will be omitted.

A driving method of the pixel PXn(m+1) shown in FIG. 24 may be the same as that shown in FIG. 18.

The second transistor Tr2 is connected to the first scan line SL1*n*, and the sixth transistor Tr6 is connected to the third scan line SL3*n* in the first pixel (e.g., the pixel PXnm shown in FIG. 17), whereas the second transistor Tr2 is connected to the third scan line SL3*n*, and the sixth transistor Tr6 is connected to the first scan line SL1*n* the second pixel (e.g., the pixel PXn(m+1) shown in FIG. 24). Therefore, high reliability of the display device 100 may be achieved by minimizing the difference in luminance between pixels PXnm disposed on the current horizontal line (or current pixel row).

As described above, an embodiment of the present invention can minimize differences in luminance between frames, and can prevent a flicker from occurring when the frames are changed by driving all light-emitting diodes included in the pixel.

In addition, an embodiment of the present invention can minimize the difference in luminance between pixels disposed on the same horizontal line (or same pixel row), and can improve reliability of the display device by driving all light-emitting diodes included in the pixel.

Effects of an embodiment of the present invention are not limited by what is illustrated in the above, and more various effects are included in the present specification.

While embodiments of the invention are described with reference to the attached drawings, those with ordinary skill in the pertinent technical field to which the present invention pertains will understand that the present invention may be carried out in other specific forms without substantially departing from the technical ideas or scope defined herein. Accordingly, the above-described embodiments should be considered in a descriptive sense, only, and not for purposes of limitation.

What is claimed is:

1. A display device comprising:

pixels connected to data lines, a first power line, and a second power line; and a data driver for supplying data signals to the data lines, wherein each of the pixels includes:

a first light-emitting diode aligned in a first direction;

a first pixel circuit for driving the first light-emitting diode, and comprising a first transistor including a first electrode connected to the first power line, a second electrode connected to a first node, and a gate electrode connected to a second node, wherein the first node is connected to a first electrode of the first light-emitting diode and a second electrode of a second light-emitting diode;

the second light-emitting diode aligned in a second direction; and a second pixel circuit for driving the second light-emitting diode, and comprising a fourth transistor including a first electrode connected to the second power line, a second electrode connected to a third node, and a gate electrode connected to a fourth node, wherein the third node is connected to a second electrode of the first light-emitting diode and a first electrode of the second light-emitting diode, and wherein the data driver supplies a first data signal to the first pixel circuit, and supplies a second data signal to the second pixel circuit, during one frame period.

2. The display device of claim 1, wherein the data driver is configured to supply the first data signal during a first period in a first frame period, is configured to supply the second data signal during a second period after the first period in the first frame period, is configured to supply the first data signal during the first period in a second frame period, and is configured to supply the second data signal during the second period in the second frame period.

3. The display device of claim 1, wherein the pixels are further connected to first scan lines, second scan lines, and a sensing line, and wherein the first pixel circuit further includes:

a second transistor connected between a respective one of the data lines and the second node and including a gate electrode connected to a respective one of the first scan lines; and a third transistor connected between the first node and the sensing line and including a gate electrode connected to a respective one of the second scan lines.

4. The display device of claim 3, wherein the pixels are further connected to third scan lines and fourth scan lines, and wherein the second pixel circuit further includes:

a fifth transistor connected between the respective one of the data lines and the fourth node and including a gate electrode connected to a respective one of the third scan lines; and a sixth transistor connected between the third node and the sensing line and including a gate electrode connected to a respective one of the fourth scan lines.

5. The display device of claim 4, wherein, in a first frame period, a first scan signal at a turn-on level is supplied to the respective one of the first scan lines during a first period, and a second scan signal at the turn-on level is supplied to the respective one of the second scan lines during the first period, and, wherein, during the first period, the first data signal is supplied to the second node, and an initialization voltage is supplied to the sensing line.

6. The display device of claim 5, wherein, in the first frame period, a third scan signal at the turn-on level is supplied to the respective one of the third scan lines during a second period after the first period, and a fourth scan signal at the turn-on level is supplied to the respective one of the fourth scan lines during the second period, and, wherein, during the second period, the second data signal is supplied to the fourth node, and the initialization voltage is supplied to the sensing line.

7. The display device of claim 6, wherein, the first data signal is a signal corresponding to a grayscale value, and wherein the second data signal is a same signal as the first data signal, or is a signal at a level that turns on the fourth transistor without corresponding to the grayscale value.

8. The display device of claim 4, wherein, in a second frame period different from a first frame period, a third scan signal at a turn-on level is supplied to the respective one of the third scan lines during a first period, and a fourth scan signal at the turn-on level is supplied to the respective one of the fourth scan lines during the first period, and, wherein, during the first period, the first data signal is supplied to the fourth node, and an initialization voltage is supplied to the sensing line.

9. The display device of claim 8, wherein, in the second frame period, a first scan signal at the turn-on level is supplied to the respective one of the first scan lines during a second period after the first period, and a second scan signal at the turn-on level is supplied to the respective one of the second scan lines during the second period, and, wherein, during the second period, the second data signal is supplied to the second node, and the initialization voltage is supplied to the sensing line.

10. The display device of claim 9, wherein, the first data signal is a signal corresponding to a grayscale value, and wherein the second data signal is a same signal as the first data signal, or is a signal at a level that turns on the first transistor without corresponding to the grayscale value.

11. The display device of claim 5, wherein the respective one of the second scan lines and the respective one of the fourth scan lines are the same, and wherein the second scan signal and a fourth scan signal are the same.

12. The display device of claim 5, wherein the second scan signal or a fourth scan signal is supplied during a same period.

13. The display device of claim 1, wherein, the pixels are further connected to first scan lines, second scan lines, third scan lines and fourth scan lines, wherein a first pixel circuit of a first pixel of the pixels is connected to a respective one of the first scan lines and a respective one of the second scan lines, wherein a second pixel circuit of the first pixel is connected to a respective one of the third scan lines and a respective one of the fourth scan lines, wherein a first pixel circuit of a second pixel disposed on a same pixel row as the first pixel is connected to the respective one of the second scan lines and the respective one of the third scan lines, and wherein a second pixel circuit of the second pixel is connected to the respective one of the first scan lines and the respective one of the fourth scan lines.

14. A display device comprising:

pixels connected to data lines, a first power line, a second power line, first scan lines, and second scan lines; and a data driver for supplying data signals to the data lines, wherein each of the pixels includes:

a first light-emitting diode aligned in a first direction;

a first pixel circuit for driving the first light-emitting diode;

a second light-emitting diode aligned in a second direction; and a second pixel circuit for driving the second light-emitting diode, and wherein the first pixel circuit includes:

a first transistor including a first electrode connected to the first powerline, a second electrode connected to a first node, and a gate electrode connected to a second node, wherein the first node is connected to a first electrode of the first light-emitting diode and a second electrode of the second light-emitting diode;

a second transistor connected between a respective one of the data lines and the second node and including a gate electrode connected to a respective one of the first scan lines;

a third transistor connected between the first node and a sensing line and including a gate electrode connected to a respective one of the second scan lines; and a fourth transistor including a first electrode connected to the second power line, a second electrode connected to a third node, and a gate electrode connected to the second node, wherein the third node is connected to a second electrode of the first light-emitting diode and a first electrode of the second light-emitting diode.

15. The display device of claim 14, wherein the pixels are further connected to third scan lines, fourth scan lines, and a sensing line, and wherein the second pixel circuit includes:

a fifth transistor including a first electrode connected to the first power line, a second electrode connected to the third node, and a gate electrode connected to a fourth node;

a sixth transistor connected between the respective one of the data lines and the fourth node and including a gate electrode connected to a respective one of the third scan lines;

a seventh transistor connected between the third node and the sensing line and including a gate electrode connected to a respective one of the fourth scan lines; and an eighth transistor including a first electrode connected to the second power line, a second electrode connected to the first node, and a gate electrode connected to the fourth node.

16. The display device of claim 15, wherein, in one frame period, a first scan signal at a turn-on level is supplied to the respective one of the first scan lines during a first period, and a second scan signal at the turn-on level is supplied to the respective one of the second scan lines during the first period, and wherein, during the first period, a first data signal is supplied to the second node, and an initialization voltage is supplied to the sensing line.

17. The display device of claim 16, wherein, in the one frame period, a third scan signal at the turn-on level is supplied to the respective one of the third scan lines during a second period after the first period, and a fourth scan signal at the turn-on level is supplied to the respective one of the fourth scan lines during the second period, and wherein during the second period, a second data signal is supplied to the fourth node, and the initialization voltage is supplied to the sensing line.

18. The display device of claim 17, wherein, the respective one of the second scan lines and the respective one of the fourth scan lines are the same, and wherein the second scan signal and the fourth scan signal are the same.

19. A display panel comprising:

a data driver connected to a first plurality of data lines;

a first plurality of pixels each connected to a corresponding one of the first plurality of data lines, respectively, and to a pair of switchable polarity power lines comprising a first power line and a second power line;

a first pixel circuit for driving a first light-emitting diode, and comprising a first transistor including a first electrode connected to the first power line, a second electrode connected to a first node, and a gate electrode connected to a second node, wherein the first node is connected to a first electrode of the first light-emitting diode and a second electrode of the second light-emitting diode; and a second pixel circuit for driving the second light-emitting diode, and comprising a fourth transistor including a first electrode connected to the second power line, a second electrode connected to a third node, and a gate electrode connected to a fourth node, wherein the third node is connected to a second electrode of the first light-emitting diode and a first electrode of the second light-emitting diode, wherein each of the first plurality of pixels includes a first light-emitting diode arranged with a first polarity, and a second light-emitting diode disposed in parallel with the first light-emitting diode and arranged with a second polarity opposite to the first polarity.

* * * * *